US009757942B2

(12) United States Patent
Masuda et al.

(10) Patent No.: US 9,757,942 B2
(45) Date of Patent: Sep. 12, 2017

(54) INKJET RECORDING METHOD AND INKJET RECORDING DEVICE

(71) Applicants: Kiminori Masuda, Tokyo (JP); Akiko Bannai, Kanagawa (JP); Takashi Tamai, Kanagawa (JP); Naoko Kitaoka, Kanagawa (JP); Kohta Akiyama, Tokyo (JP)

(72) Inventors: Kiminori Masuda, Tokyo (JP); Akiko Bannai, Kanagawa (JP); Takashi Tamai, Kanagawa (JP); Naoko Kitaoka, Kanagawa (JP); Kohta Akiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/939,266

(22) Filed: Nov. 12, 2015

(65) Prior Publication Data

US 2016/0144620 A1 May 26, 2016

(30) Foreign Application Priority Data

Nov. 21, 2014 (JP) ..... 2014-236562

(51) Int. Cl.
*B41J 2/21* (2006.01)
*B41J 2/045* (2006.01)

(52) U.S. Cl.
CPC ..... *B41J 2/04588* (2013.01); *B41J 2/04573* (2013.01); *B41J 2/04581* (2013.01); *B41J 2/2107* (2013.01)

(58) Field of Classification Search
CPC B41J 2/04598; B41J 2/04586; B41J 2/04581; B41J 2/14274; B41J 2/04588;
(Continued)

(56) References Cited

U.S. PATENT DOCUMENTS 5,560,770 A * 10/1996 Yatake ..... C09D 11/30 347/100
2003/0177940 A1 9/2003 Fujioka et al.
(Continued)

FOREIGN PATENT DOCUMENTS

JP 04-035344 6/1992
JP 04-241948 8/1992
(Continued)

*Primary Examiner* — Manish S Shah
(74) *Attorney, Agent, or Firm* — Oblon, McClelland, Maier & Neustadt, L.L.P.

(57) ABSTRACT

An inkjet recording method performed by inkjet recording device including nozzle plate with nozzle to eject droplets of ink; recording head including liquid chamber with which the nozzle is in communication, and pressure-generating unit configured to generate pressure in the liquid chamber; and signal-generating unit configured to generate signal applied to the pressure-generating unit, and allowing the droplets of the ink to eject by the pressure generated by the pressure-generating unit according to the signal, wherein the ink has static surface tension of 18.0 mN/m to 27.0 mN/m at 25° C., the ink has receding contact angle on the nozzle plate of less than 50°, the signal has two-step pull pulse for pulling the ink into the nozzle in two-step manner within one printing unit cycle, and the method includes pulling the ink located in proximity to nozzle outlet into the nozzle of the two-step pull pulse, to form meniscus at predetermined position.

13 Claims, 18 Drawing Sheets

(58) Field of Classification Search
CPC ..... B41J 2/04595; B41J 2/04573; B41J 2/01; B41J 2/211; B41J 2/1433; B41J 2/17; B41J 2/17593; B41J 2/2107; B41J 2/1755; B41J 2/2114; B41J 11/0015; B41J 11/002; B41J 2/2056; B41J 2/21; B41J 2/0057; B41J 3/60; C09D 11/40; C09D 11/36; C09D 11/30; C09D 11/38; C09D 11/322; C09D 11/328; C09D 11/101; C09D 11/005; C09D 11/54; C09D 11/52
See application file for complete search history.

(56) References Cited

U.S. PATENT DOCUMENTS

2004/0257420 A1 12/2004 Ichizawa et al.
2009/0130313 A1* 5/2009 Ohshima ..... B41M 5/0023 427/288
2010/0053269 A1 3/2010 Fujii et al.
2011/0063351 A1 3/2011 Kitaoka
2011/0122195 A1* 5/2011 Kovacs ..... B41J 2/14008 347/45
2013/0307912 A1 11/2013 Masuda et al.
2014/0253618 A1* 9/2014 Masuda ..... B41J 2/04581 347/10
2015/0258796 A1 9/2015 Tamai et al.
2016/0185110 A1* 6/2016 Masuda ..... B41J 2/04581 347/10

FOREIGN PATENT DOCUMENTS

JP 10-034941 2/1998
JP 2003-277651 10/2003
JP 2005-008690 1/2005
JP 2006168296 A * 6/2006 ..... B41J 2/045
JP 2010-076422 4/2010
JP 2011-062821 3/2011
JP 2015-071291 4/2015
WO WO 2015/034027 A1 3/2015

* cited by examiner

INKJET RECORDING METHOD AND INKJET RECORDING DEVICE

BACKGROUND OF THE INVENTION

Field of the Invention

The present invention relates to an inkjet recording method and an inkjet recording device.

Description of the Related Art

An inkjet recording system is a recording system in which ink droplets are ejected from very minute nozzles to deposit on a recording medium, to thereby form characters or an image. This system has been recently widely used because formation of a full-color image is easier compared to other recording systems, and a high resolution image can be obtained even with a device having a simple configuration.

An ink used in the inkjet recording system requires different properties. In particular, ejection stability upon ejection of the ink from a head is an important factor that determines image quality.

An ink composition used in the inkjet recording system generally contains a colorant, a wetting agent, and water.

In the inkjet recording system, ink droplets are ejected by applying fluctuating voltage to an ink.

A meniscus is formed inside a nozzle of a head filled with the ink. In a normal (static) state, the meniscus forms a bridge from a nozzle edge toward a liquid chamber side. However, when positive pressure is applied to the ink in the nozzle due to voltage fluctuation upon ejection, the meniscus is broken, potentially leading to overflow of the ink from an outlet. Additionally, an ejected ink droplet may be torn off, or fine ink mist produced through scatter of ink droplets impacted on a substrate to be printed may deposit on a nozzle plate surface. The ink overflowed from the outlet or the ink mist deposited on the nozzle plate surface in the above described manner forms an ink puddle on the nozzle plate. When the ink puddle is brought into contact with ink droplet ejected, the meniscus turns into an asymmetric form or the ink droplet is pulled toward the ink puddle, potentially leading to deflection of an ejection direction. In an ink containing the pigment as the colorant, the pigment in the solid form is dispersed in a solvent. Therefore, when the ink deposited on the surface of the nozzle plate is dried, the pigment in the solid form adheres to the surface of the nozzle plate, eventually leading to a clogged nozzle.

Thus, in the inkjet recording system, keeping a periphery of the nozzle clean is important for ensuring stable ejection. Therefore, in order to prevent the surface of the nozzle plate from being smeared with the ink, a maintenance work has generally been performed including forming a water-repellent film onto the surface of the nozzle plate to thereby make the surface be ink-repellent and periodically wiping the surface of the nozzle plate to thereby remove the ink on the surface of the nozzle plate.

However, the water-repellent film has been known to be gradually peeled off from the nozzle plate surface by the action of the wiping.

Therefore, there has been proposed a method for improving durability of the water-repellent film in order to prevent deterioration thereof (e.g., see Japanese Patent Application Laid-Open (JP-A) No. 2010-76422).

However, the above proposed method cannot prevent the water-repellent film from being peeled off to a certain extent. Therefore, at an area at which the water-repellent film has been peeled off, image quality is deteriorated by tendency for the ink to adhere thereto, ejection disturbance, ejection deflection, and streaks on printed matter, which is problematic. Depending on properties of the ink, the nozzle plate surface has lowered ink-repellency and the ink cannot be sufficiently removed even through the wiping, which is also problematic.

For the purpose of stably ejecting an ink and providing a sharp image with little blur, there has been proposed an inkjet recording ink which contains self-dispersing colorant particles, and which has the static surface tension of 30 mN/m to 50 mN/m, the advancing contact angle of 65° or more and the receding contact angle of 55° or more on the nozzle plate surface of the recording head, and a difference between the advancing contact angle and the receding contact angle of 20° or less (e.g., JP-A No. 2003-277651).

However, in this proposed ink, ejection stability cannot be ensured in the case of low static surface tension, which is problematic.

JP-A No. 2011-62821 proposes a method for improving ejection reliability by shortening an entire drive waveform within one printing cycle to thereby increase the printing speed, and forming an ejection pulse including a waveform element corresponding to size of ink droplets.

JP-A No. 10-34941 proposes an inkjet recording head which allows a pigment ink located on a surface of a nozzle plate to be fully removed with a wiping unit by defining a difference between the advancing contact angle and the receding contact angle of the pigment ink on the surface of the nozzle plate in the inkjet recording head.

Japanese Patent Application Publication (JP-B) No. 04-35344 proposes an inkjet recording head which allows an ink to jet accurately and stably by defining the advancing contact angle and the receding contact angle of the ink on a surface of a nozzle plate.

JP-A No. 04-241948 proposes an inkjet recording head which has a high liquid-repellency by defining a relationship (the receding contact angle of the ink) between the inkjet recording head and a liquid-repellent treatment agent for liquid-repellent treating an end face of the inkjet recording head provided with an ink outlet.

However, these proposals have a problem that a water-repellent film formed on a nozzle plate surface is gradually peeled off under the influence of the wiping.

Therefore, in the present, there is a need to provide an inkjet recording method which allows an ink having a low static surface tension and a small receding contact angle to eject stably and which achieves an excellent image even when a water-repellent film formed onto a surface of a nozzle plate is deteriorated.

SUMMARY OF THE INVENTION

An object of the present invention is to provide an inkjet recording method which allows an ink having a low static surface tension and a small receding contact angle to eject stably and which achieves an excellent image.

A means for solving the above problems is as follows.

An inkjet recording method, which is performed by an inkjet recording device containing a nozzle plate provided with a nozzle configured to eject droplets of an ink, a recording head including a liquid chamber with which the nozzle is in communication, and a pressure generating unit configured to generate pressure in the liquid chamber, and a signal generating unit configured to generate a signal to be applied to the pressure generating unit, and which allows the droplets of the ink to eject by the action of the pressure which is generated by the pressure generating unit according to the signal, wherein the ink has a static surface tension of 18.0 mN/m to 27.0 mN/m at 25° C., the ink has a receding contact angle of less than 50° on the nozzle plate, the signal has a two-step pull pulse for pulling the ink into the nozzle in a two-step manner within one printing unit cycle, and the inkjet recording method includes pulling the ink located in proximity to a nozzle outlet into the nozzle by the action of the two-step pull pulse, to thereby form a meniscus at a predetermined position.

The present invention can provide an inkjet recording method which allows an ink having a low static surface tension and a small receding contact angle to eject stably and which achieves an excellent image.

Figure 1:
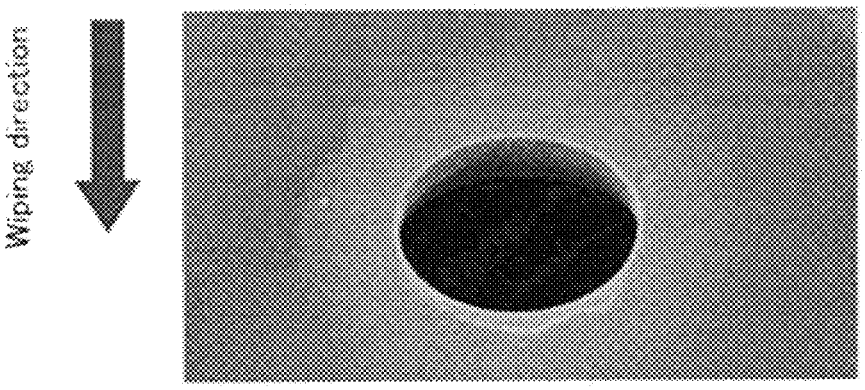
FIG. 1 is a SEM image illustrating a deteriorated water-repellent film on a surface of a nozzle plate.

DETAILED DESCRIPTION OF THE INVENTION (Inkjet Recording Method and Inkjet Recording Device)

An inkjet recording method of the present invention is performed by an inkjet recording device including a nozzle plate provided with a nozzle configured to eject droplets of an ink; a recording head including a liquid chamber with which the nozzle is in communication, and a pressure generating unit configured to generate pressure in the liquid chamber; and a signal generating unit configured to generate a signal to be applied to the pressure generating unit.

The inkjet recording method allows the droplets of the ink to eject by the action of the pressure which is generated by the pressure generating unit according to the signal.

In the inkjet recording method, the ink has a static surface tension of 18.0 mN/m to 27.0 mN/m at 25° C.

In the inkjet recording method, the ink has a receding contact angle of less than 50° on the nozzle plate.

In the inkjet recording method, the signal has a two-step pull pulse for pulling the ink into the nozzle in a two-step manner within one printing unit cycle.

The inkjet recording method includes pulling the ink located in proximity to a nozzle outlet into the nozzle by the action of the two-step pull pulse, to thereby form a meniscus at a predetermined position.

An inkjet recording device includes a nozzle plate provided with a nozzle configured to eject droplets of an ink; a recording head including the nozzle configured to eject the droplets of the ink, a liquid chamber with which the nozzle is in communication, and a pressure generating unit configured to generate pressure in the liquid chamber; and a signal generating unit configured to generate a signal to be applied to the pressure generating unit.

The inkjet recording device allows the droplets of the ink to eject by the action of the pressure which is generated by the pressure generating unit according to the signal.

In the inkjet recording device, the ink has a static surface tension of 18.0 mN/m to 27.0 mN/m at 25° C.

In the inkjet recording device, the ink has a receding contact angle of less than 50° on the nozzle plate.

In the inkjet recording device, the signal has a two-step pull pulse for pulling the ink into the nozzle in a two-step manner within one printing unit cycle.

The inkjet recording device includes a unit configured to allow the ink located in proximity to a nozzle outlet to be pulled into the nozzle by the action of the two-step pull pulse, to thereby form a meniscus at a predetermined position.

The liquid ejection head is formed by stacking a flow channel plate, an oscillation plate joined to a lower surface of this flow channel plate, and a nozzle plate joined to an upper surface of this flow channel plate to thereby form a nozzle including an opening (nozzle opening) configured to eject droplets (ink droplets). The nozzle configured to eject droplets (ink droplets) connects to a nozzle communication path, a pressure chamber serving as a pressure generating chamber, and an ink supply port in communication with a common liquid chamber for supplying ink to the pressure chamber via a fluid resistor section (fluid supply path).

That is, the liquid ejection head includes the pressure chamber in communication with the nozzle opening configured to eject the ink droplets, and a pressure generating element configured to allow the pressure to fluctuate in the pressure chamber.

On the nozzle plate, the nozzles (nozzle opening) are formed corresponding to the pressure chamber. The nozzle plate is formed of, for example, a nozzle forming member (e.g., a metal member), and is preferably those in which a water-repellent layer (water-repellent film) is formed on an outermost surface of the nozzle forming member. That is, a surface of the nozzle (nozzle opening) is preferably subjected to a water-repellent treatment.

The term "in proximity to a nozzle outlet" means a periphery of the nozzle opening.

The term "liquid ejection head" is synonymous with "inkjet recording head" and hereinafter may be referred to simply as "head."

In the inkjet recording method of the present invention, a drive signal generating unit generates an ejection pulse corresponding to the size of the ink droplets. The ejection pulse is constituted by selecting a drive pulse from a drive waveform including one or more time-series drive pulses.

Notably, the term "drive pulse" means a pulse serving as an element constituting a drive waveform. The term "ejection pulse" means a pulse applied to a liquid ejection head equipped with a pressure generating element to thereby eject liquid droplets.

The drive pulse includes an expanding waveform element which is a waveform element configured to fall from a reference potential to a predetermine hold potential to thereby expand the pressure chamber; a holding element which is a waveform element configured to hold the fallen potential (hold potential); and a contracting waveform element which is a waveform element configured to raise from the hold potential to thereby contract the pressure chamber.

Depending on the size of the ink droplet, the ejection pulse is generated by selecting a drive pulse from a drive waveform including one or more time-series drive pulses. For example, drive pulses allowing droplets having three different sizes (i.e., large droplets, medium droplets, and small droplets) to eject can be selected.

The term "predetermined position" used in the phrase "form a meniscus at a predetermined position" means a regular position at which a meniscus is formed, that is, a position at which a meniscus is formed in a concave manner from a reference plane when viewed from a cross section of the opening on the nozzle plate.

As illustrated in a SEM (Scanning Electron Microscope) image in FIG. 1, the water-repellent film on a surface of the nozzle plate opposite to a surface facing the liquid chamber is gradually deteriorated due to a physical load applied during a maintenance work.

Figure 2:
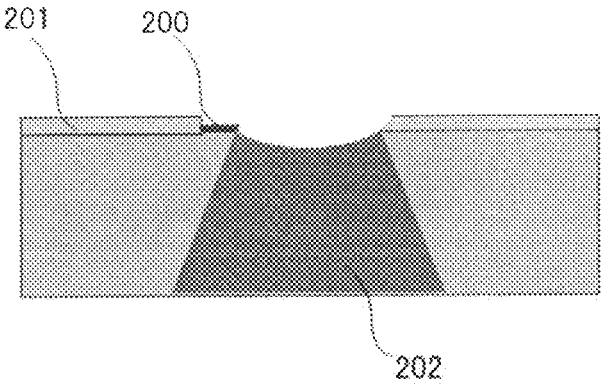
FIG. 2 is a schematic diagram illustrating a normal meniscus.

A meniscus is originally formed in a nozzle of a head which is filled with the ink. In a normal (static) state, the meniscus forms a bridge from a nozzle edge toward a liquid chamber side, so that the ink is less affected by a deteriorated water-repellent film on the nozzle (see FIG. 2). In FIG. 2, the reference sign 200 denotes a deteriorated water-repellent film, the reference sign 201 denotes a water-repellent film, and the reference sign 202 denotes an ink. The above described reference signs also have the same meanings in FIGS. 3 to 12. In graphs of FIGS. 5B to 12B, portions indicated by bold lines in signal waveforms correspond to signals applied in states shown in the figures, respectively. In each of graphs of FIGS. 5B to 12B, a horizontal axis represents the time and a vertical axis represents the voltage.

Figure 3:
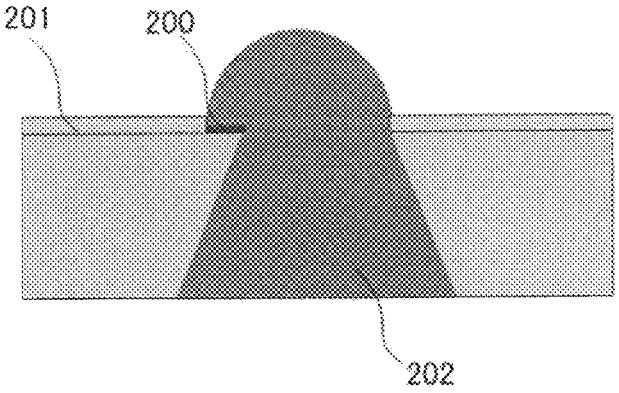
FIG. 3 is a schematic diagram illustrating a state in which meniscus overflow is occurred immediately after droplets are ejected.
Figure 4:
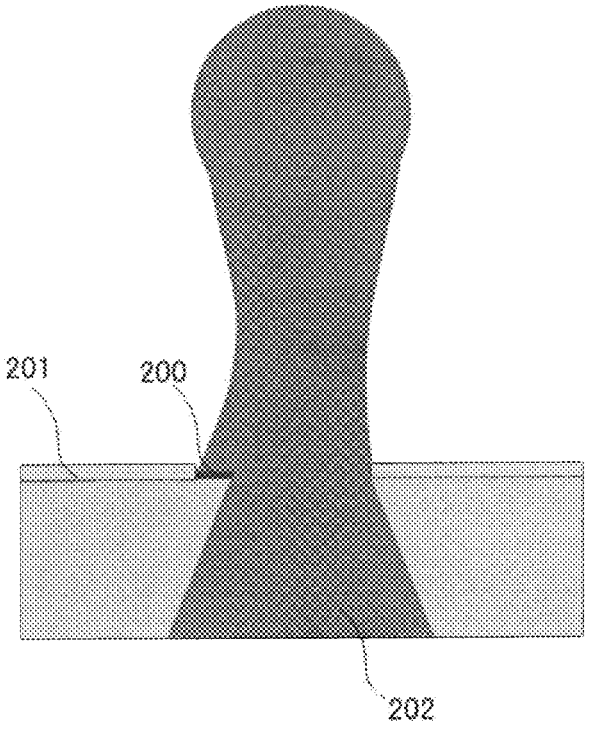
FIG. 4 is a schematic diagram illustrating a state in which ink droplet deflection is occurred.

However, as shown in FIGS. 3 and 4, when the ink overflows outward from the nozzle after droplets of the ink 202 are ejected, such as in a meniscus overflow or a meniscus overflow immediately after high-frequency drive, the meniscus turns into an asymmetric form under the influence of the deteriorated water-repellent film (see FIG. 3). The meniscus overflow means a phenomenon in which the ink overflows from the nozzle with excessive momentum when the ink droplets are ejected. This is because an outflow of the ink from the nozzle causes an inflow of the ink from the common liquid chamber into the nozzle, but the inflow of the ink cannot be stopped immediately after the completion of the ejection. In particular, a waveform for ejecting large droplets within one printing unit cycle (a large amount of the ink is injected per unit time) causes a great meniscus overflow. The meniscus over flow immediately after high-frequency drive means a phenomenon in which the ink overflows from the nozzle with excessive momentum when a large amount of the ink is ejected by the action of high-frequency drive. This is because an outflow of the ink from the nozzle causes an inflow of the ink from the common liquid chamber into the nozzle, but the inflow of the ink cannot be stopped immediately after the completion of the ejection. In this case, there is a refill period Rf which is different from a natural oscillation period Tc of the liquid chamber. Then, subsequent droplets are ejected in the state in which the meniscus is in the asymmetric form, which causes the droplets to deflect from the original direction (see FIG. 4).

As shown in FIGS. 5A to 7B, in the case of using a conventional ejection pulse, when the ink is ejected in the state in which the meniscus overflow has been occurred, the ink overflowed onto the deteriorated water-repellent film is not sufficiently pulled into the nozzle, so that the overflowed ink remains on the deteriorated water-repellent film even immediately before the droplets are injected. Accordingly, the droplets are caused to deflect from the original direction.

Figure 5A:
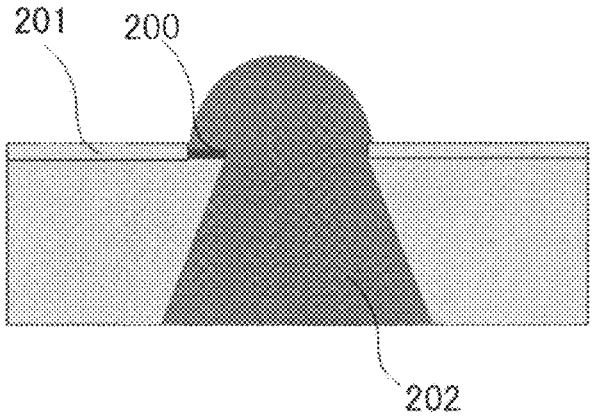
FIG. 5A is a schematic diagram illustrating a state in which a meniscus overflow is occurred by a normal ejection.
Figure 5B:
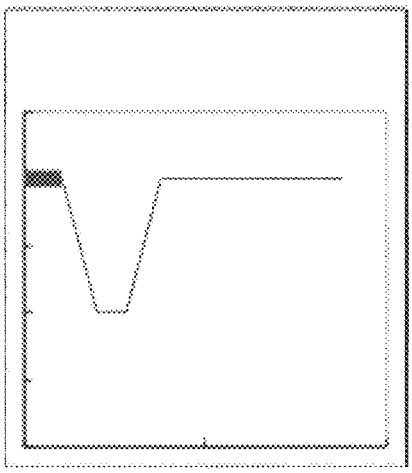
FIG. 5B is a graph illustrating a signal in the state illustrated in FIG. 5A.
Figure 6A:
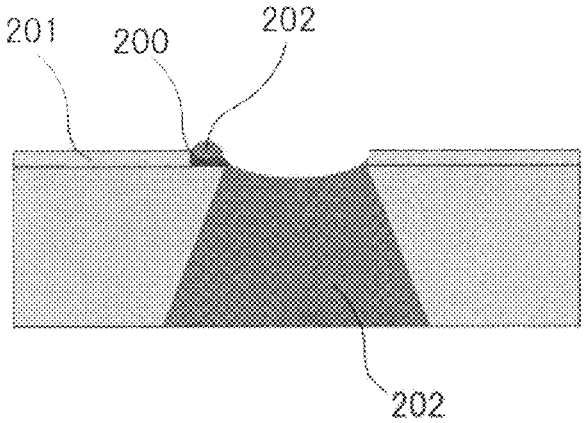
FIG. 6A is a schematic diagram illustrating a state in which an ink overflowed by a normal ejection remains on a deteriorated water-repellent film.
Figure 6B:
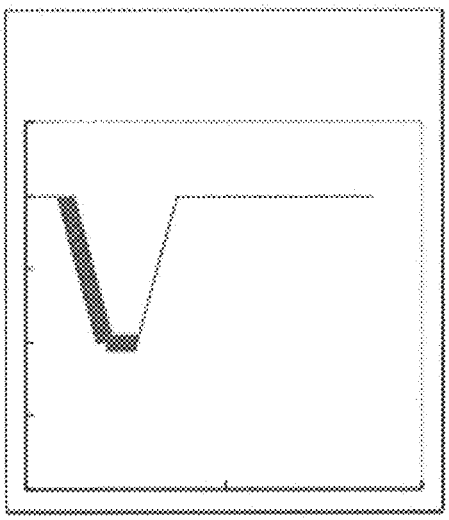
FIG. 6B is a graph illustrating a signal in the state illustrated in FIG. 6A.
Figure 7A:
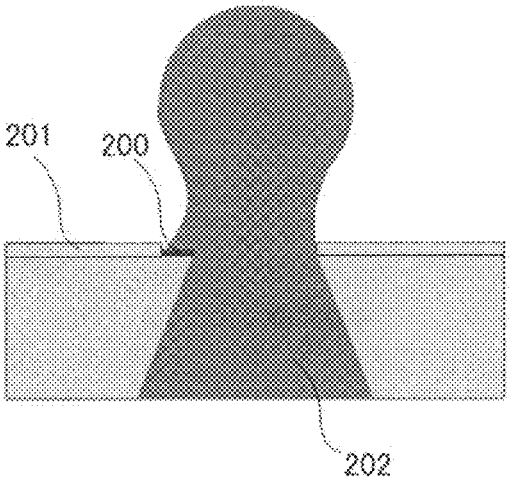
FIG. 7A is a schematic diagram illustrating a state in which ink droplet deflection is occurred by a normal ejection.
Figure 7B:
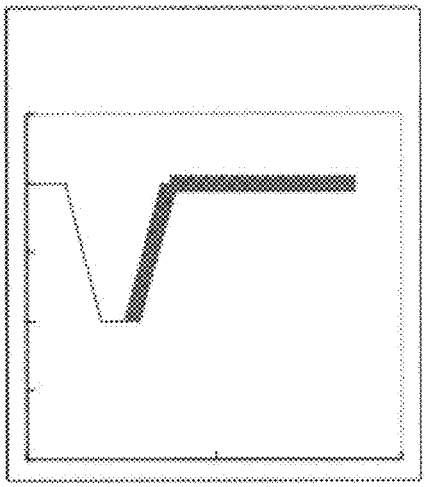
FIG. 7B is a graph illustrating a signal in the state illustrated in FIG. 7A.
Figure 8A:
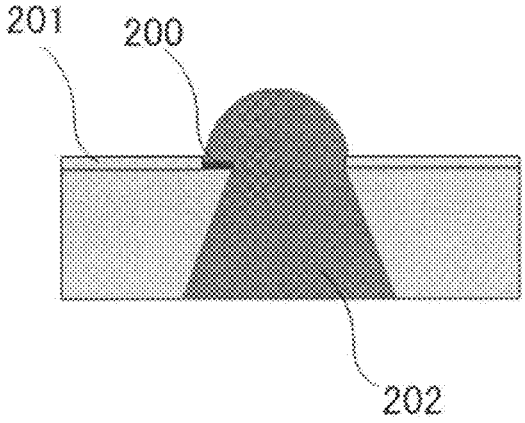
FIG. 8A is a schematic diagram illustrating a state in which a meniscus overflow is occurred.
Figure 8B:
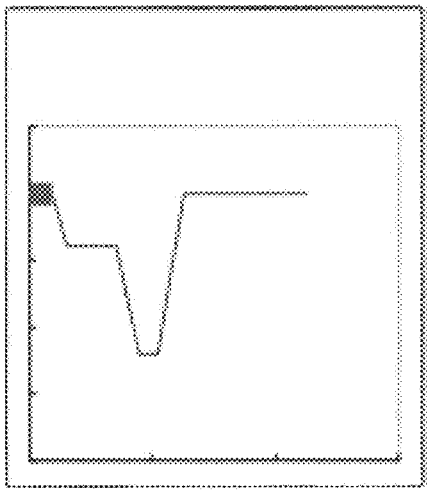
FIG. 8B is a graph illustrating a signal in the state illustrated in FIG. 8A.

Notably, FIGS. 5B, 6B, and 7B represent signals in the states illustrated in FIGS. 5A, 6A, and 7A, respectively.

As described below in more detail, when the meniscus is pulled into the nozzle by applying a pulse in the state in which the meniscus overflow has been occurred (see FIG. 5A), the ink 202 partially remains on the deteriorated water-repellent film 200 as illustrated in FIG. 6A. When the subsequent ink 202 is ejected by applying the ejection pulse for ejecting the ink 202 from the nozzle in the state in which the ink 202 remains on the deteriorated water-repellent film 200, the ink 202 remaining on the deteriorated water-repellent film 200 coalesces with the subsequent ink 202. As a result, as illustrated in FIG. 7A, the droplet of the ink is caused to deflect from the original direction.

On the other hand, in the present invention, as illustrated in FIGS. 8A to 12B, the meniscus is pulled into the nozzle in a two-step manner, so that no ink 202 remains on the deteriorated water-repellent film 200. Therefore, the droplet of the ink can be prevented from deflecting from the original direction.

Figure 9A:
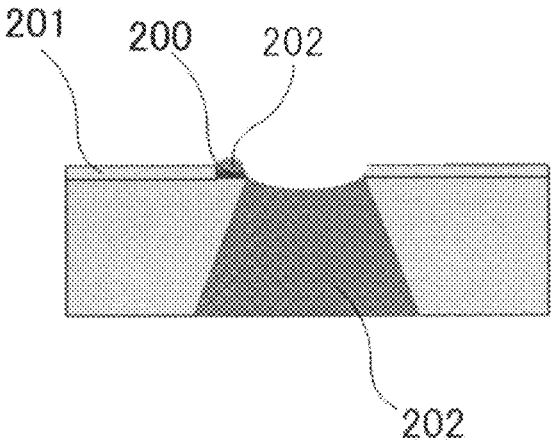
FIG. 9A is a schematic diagram illustrating a state in which a meniscus is pulled into a nozzle in the first step.

As described below in detail, when the meniscus is pulled into the nozzle by applying a pulse in the state in which the meniscus overflow has been occurred (see FIG. 8A), as the first step, the meniscus is pulled into the nozzle by applying a relatively small pulse (see FIG. 9B), so that the ink 202 remains on the deteriorated water-repellent film 200 (see FIG. 9A). Thereafter, the pulse is kept at the same amplitude as the first step (see FIG. 10B). As a result, the ink 202 within the nozzle coalesces with the ink 202 remaining on the deteriorated water-repellent film 200 (see FIG. 10A). Then, as the second step, the meniscus is pulled into the nozzle by applying a pulse which is relatively larger than the pulse in the first step (see FIG. 11B). As a result, the meniscus can be pulled into the nozzle without allowing the ink 202 to remain on the deteriorated water-repellent film 200 (see FIG. 11A). When the ink 202 is ejected by applying the ejection pulse (see FIG. 12B) in this state, the droplet of the ink can be prevented from deflecting from the original direction (see FIG. 12A).

Notably, as used herein, the term "pulse" means a signal which sharply changes in a short time.

Figure 9B:
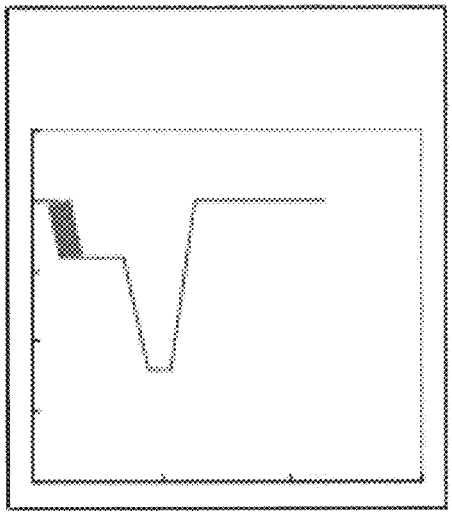
FIG. 9B is a graph illustrating a signal in the state illustrated in FIG. 9A.
Figure 10A:
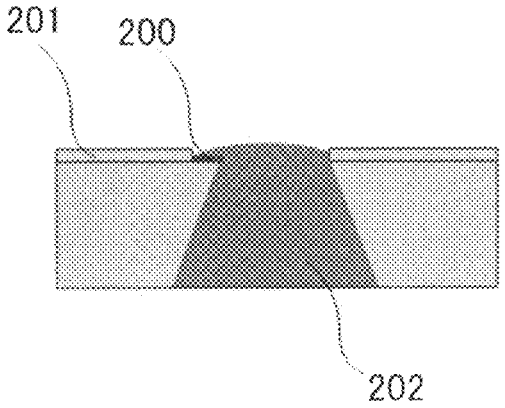
FIG. 10A is a schematic diagram illustrating a state in which an ink 202 in a nozzle and an ink 202 on a deteriorated water-repellent film 200 coalesce together.
Figure 10B:
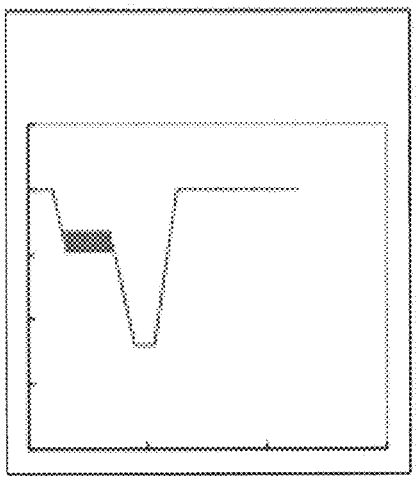
FIG. 10B is a graph illustrating a signal in the state illustrated in FIG. 10A.
Figure 11A:
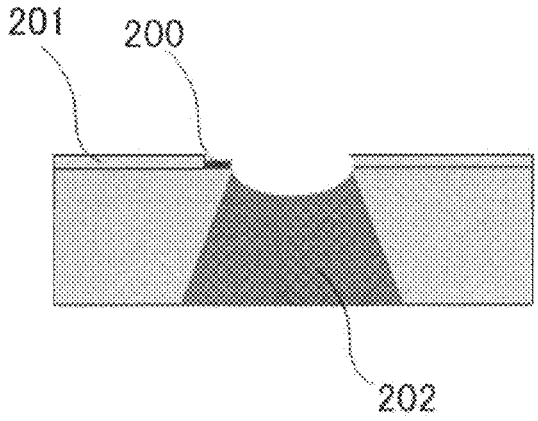
FIG. 11A is a schematic diagram illustrating a state in which a meniscus is pulled into a nozzle in the second step.
Figure 11B:
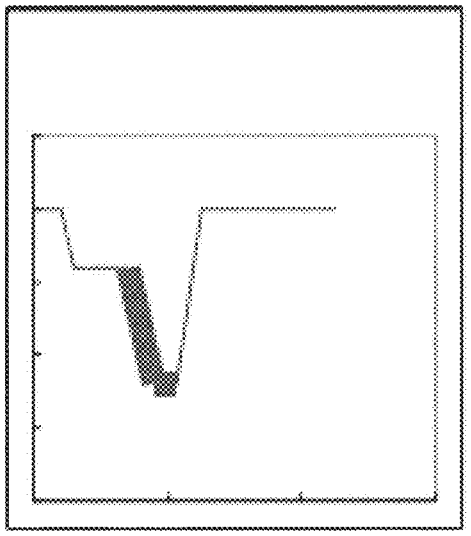
FIG. 11B is a graph illustrating a signal in the state illustrated in FIG. 11A.
Figure 12A:
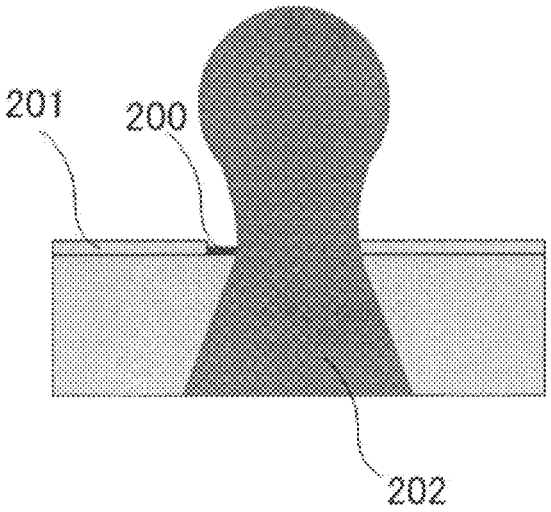
FIG. 12A is a schematic diagram illustrating a state in which an ink 202 is ejected.
Figure 12B:
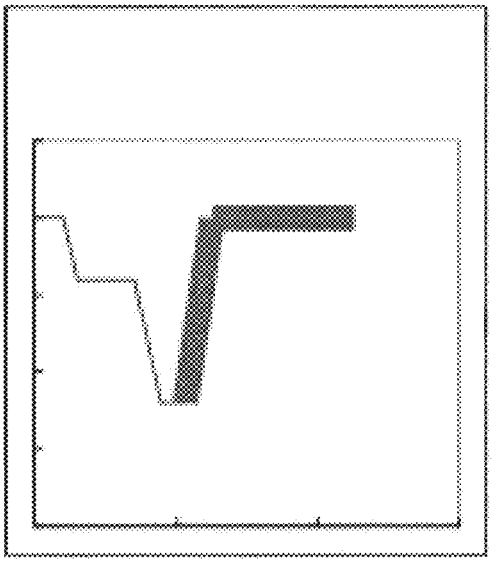
FIG. 12B is a graph illustrating a signal in the state illustrated in FIG. 12A.

Each of stepwise pulses illustrated in FIGS. 9B, 10B, and 11B represents a pull pulse.

An ink used in the present invention has the low static surface tension of 18.0 mN/m to 27.0 mN/m at 25° C. After the ink is impacted on a recording medium, the ink wets and spreads on the recording medium well and rapidly penetrates into the recording medium. Accordingly, the ink tends to achieve excellent color development and high image quality. However, the ink also easily wets and spreads on a surface of the nozzle plate, making it difficult to ensure continuous ejection stability.

The ink has the receding contact angle on the nozzle plate of less than 50°. The ink having such a small receding contact angle is hardly released from the surface of the nozzle plate. That is, when the ink overflows onto the surface of the nozzle plate, the overflowed droplets are hardly released from the surface even by being pulled by the subsequently ejected droplets, which is disadvantageous for the ejection stability.

Therefore, the ink which is spread to far away from the nozzle opening disadvantageously remains on the surface of the nozzle plate. As a result, the residual ink gradually accumulates, which finally adversely affects the ejection.

A means for controlling the receding contact angle to less than 50° is not particularly limited and may be appropriately selected depending on the intended purpose. For example, the receding contact angle can be decreased by increasing an amount of a surfactant and a penetrating agent added to the ink, by changing a surfactant to those having a higher ability to reduce the surface tension, or by decreasing water-repellency of the water-repellent film on the nozzle plate.

According to the present invention, the meniscus is pulled into the nozzle in the two-step manner by applying the pull pulse, so that even the ink which has spread away from the nozzle opening can pulled into the meniscus two times. Therefore, almost all of the overflowed ink is collected. As a result, the ejection is less adversely affected and an excellent image can be obtained.

According to the present invention, an inkjet recording method which allows an ink having a low static surface tension and a small receding contact angle to eject stably and which achieves an excellent image can be provided. The inkjet recording method exhibits a remarkable effect especially in the case where a water-repellent film on a nozzle plate is deteriorated.

In the signal within one printing unit cycle, the pull pulse is preferably present prior to the ejection pulse for ejecting the ink.

As used herein, the term "one printing unit cycle" means a time interval for which each dot is formed on a medium by each actuator.

The "one printing unit cycle" includes a step of applying the ejection pulse and a step of pulling the ink in a two-step manner.

The "one printing unit cycle" has been described in JP-A Nos. 2001-146011, 10-81012, and 2011-062821 in detail.

For example, JP-A No. 10-81012 describes an inkjet recording device which ejects a plurality of ink droplets from each nozzle of an inkjet head within the one printing unit cycle for which one dot is formed on a recording medium to thereby form one dot from the plurality of ink droplets.

The inkjet recording device includes an inkjet head including a head main body provided with a pressure chamber for housing an ink and a nozzle in communication with the pressure chamber, an actuator configured to apply the pressure to the ink housed in the pressure chamber so that ink droplets are ejected from the nozzle by a piezoelectric effect of a piezoelectric element, and a driving signal supplying unit configured to supply a driving signal to the actuator; and a relative moving unit configured to relatively move the inkjet head and a recording medium to each other.

Figure 21:
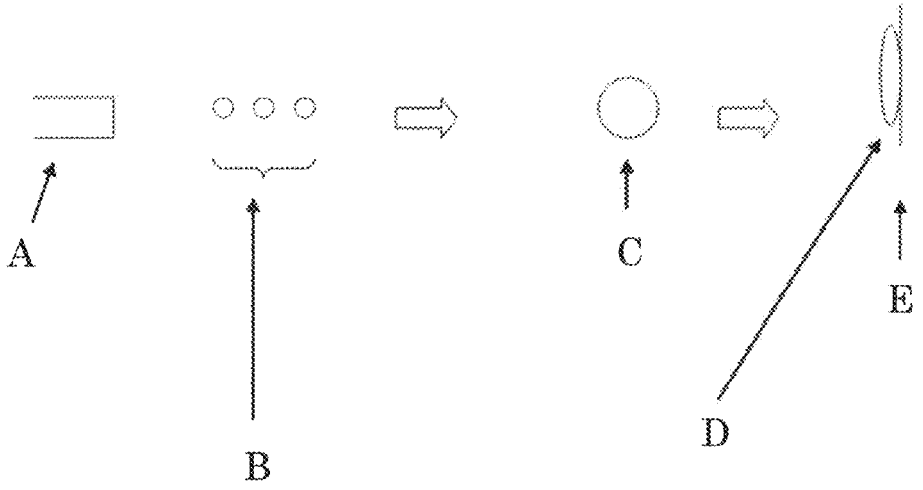
FIG. 21 is a diagram illustrating one printing unit cycle.

As illustrated in FIG. 21, while the relative moving unit relatively moves the inkjet head and the recording medium to each other, the driving signal supplying unit supplies to the actuator the driving signal including a plurality of (i.e., one or two or more) drive pulses within the one printing unit cycle to thereby eject a plurality of (i.e., one or two or more) ink droplets from the nozzle. In FIG. 21, A indicates a head, B indicates a plurality of droplets ejected to form one dot, C indicates a situation where the plurality of droplets coalesces with each other in the air, and D indicates a situation where one dot is formed on a sheet of paper, and E indicates paper.

The plurality of ink droplets ejected in the above-described manner form one dot on the recording medium.

A plurality of the dots is arranged on the recording medium to thereby form a predetermined image on the recording medium.

The dots are adjusted in shade of color or size by adjusting the number of the ink droplets ejected within the one printing unit cycle, which allows for a so-called multi-gradation printing.

In the present invention, the following configurations are preferable. In the first configuration, droplets ejected within the one printing unit cycle are allowed to coalesce with each other in the air, and then be deposited on the recording medium. In the second configuration, droplets ejected within the one printing unit cycle are sequentially deposited on the recording medium in the order of ejection. In the third configuration, only one droplet is deposited on the recording medium. All of these three configurations are available. Preferable is the first configuration in which droplets ejected within the one printing unit cycle are allowed to coalesce with each other in the air, and then be deposited on the recording medium, because the ink has a nearly circular shape when the ink is impacted on the recording medium, and the ink is impacted at the accurate position on the recording medium.

<Ink>

The ink has the static surface tension of 18.0 mN/m to 27.0 mN/m at 25° C.

The ink has the receding contact angle on the nozzle plate of less than 50°.

The static surface tension of 18.0 mN/m to 27.0 mN/m is advantageous in terms of bleeding on a recording medium and ejection stability.

It is advantageous that the receding contact angle is less than 50° from the viewpoint of rapid penetrability into the recording medium. Notably, the lower limit of the receding contact angle is not particularly limited in terms of penetrability because the smaller the receding contact angle is, the rapider the penetration is. However, the lower limit preferably does not fall below 20° (is preferably 20° or more) in view of ejection stability due to wet-spreadability on a nozzle surface.

The static surface tension can be measured with an automatic tensiometer (CBVP-Z, manufactured by Kyowa Interface Science Co., Ltd) using a platinum plate method.

The receding contact angle can be measured with an automatic contact angle meter. The automatic contact angle meter may be OCA200H (manufactured by Data Physics Corporation). The receding contact angle can be measured as follows. Onto an outer surface of the nozzle used in the present invention, 3 μL of an ink is ejected from a syringe, following by subjecting to a measurement with the automatic contact angle meter using a contraction method. The "receding contact angle," as used herein, means a value as measured at 25° C.

The ink contains, for example, water, a colorant, a surfactant, and a water-soluble organic solvent; and, if necessary, further contains other components.

<<Colorant>>

The colorant may be a dye or a pigment, but is preferably the pigment from the viewpoints of water resistance and lightfastness of printed matter. Examples of the pigment include an organic pigment and an inorganic pigment. These may be used alone or in combination.

Examples of the organic pigment include azo-pigments, phthalocyanine-based pigments, anthraquinone-based pigments, dioxazine-based pigments, indigo-based pigments, thioindigo-based pigments, perylene-based pigments, isoindolinone-based pigments, aniline black, azomethine-based pigments and rhodamine B lake pigments.

Examples of the inorganic pigment include carbon black, iron oxide, titanium oxide, calcium carbonate, barium sulfate, aluminium hydroxide, barium yellow, iron blue, cadmium red, chrome yellow and metal powder.

Specific examples of black pigments include carbon blacks (C. I. Pigment Black 7) such as furnace black, lamp black, acetylene black, and channel black; metals such as copper oxides, iron oxides (C. I. Pigment Black 11), and titanium oxide; and organic pigments such as aniline black (C. I. Pigment Black 1).

Specific examples of yellow pigments include C. I. Pigment Yellow 1 (Fast Yellow G), 2, 3, 12 (Disazo Yellow AAA), 13, 14, 16, 17, 20, 23, 24, 34, 35, 37, 42 (yellow iron oxide), 53, 55, 73, 74, 75, 81, 83 (Disazo Yellow HR), 86, 93, 95, 97, 98, 100, 101, 104, 108, 109, 110, 114, 117, 120, 125, 128, 129, 137, 138, 139, 147, 148, 150, 151, 153, 154, 155, 166, 168, 180, and 185.

Specific examples of magenta pigments include C. I. Pigment Violet 19, and C. I. Pigment Red 1, 2, 3, 5, 7, 9, 12, 17, 22 (Brilliant Fast Scarlet), 23, 31, 38, 48:1 [Permanent Red 2B (Ba)], 48:2 [Permanent Red 2B (Ca)], 48:3 [Permanent Red 2B (Sr)], 48:4 [Permanent Red 2B (Mn)], 49:1, 52:2, 53:1, 57:1 (Brilliant Carmine 6B), 60:1, 63:1, 63:2, 64:1, 81 (Rhodamine 6G Lake), 83, 88, 92, 97, 101 (iron oxide red), 104, 105, 106, 108 (cadmium red), 112, 114, 122 (dimethylquinacridone), 123, 146, 149, 166, 168, 170, 172, 175, 176, 178, 179, 180, 184, 185, 190, 192, 193, 202, 209, 215, 216, 217, 219, 220, 223, 226, 227, 228, 238, 240, 254, 255, and 272.

Specific examples of cyan pigments include C. I. Pigment Blue 1, 2, 3, 15 (Copper Phthalocyanine Blue R), 15:1, 15:2, 15:3 (Phthalocyanine Blue G), 15:4, 15:6 (Phthalocyanine Blue E), 16, 17:1, 22, 56, 60, 63, and 64, Vat Blue 4, and Vat Blue 60.

Specific examples of pigments for intermediate colors, i.e., red, green, and blue, include C. I. Pigment Red 177, 194, and 224, C. I. Pigment Orange 16, 36, 43, 51, 55, 59, 61, and 71, C. I. Pigment Violet 3, 19, 23, 29, 30, 37, 40, and 50 and C. I. Pigment Green 7 and 36.

The ink used in the present invention may contain, as the colorant, polymer particles containing a hydrophobic dye or pigment in order to improve printing density and printing durability. The polymer particles are used in the form of a dispersion. More preferably, the dispersion of the polymer particles contains the pigment, in particular, the organic pigment or carbon black. Examples of a polymer used for the dispersion of the polymer particles containing the pigment include a vinyl-based polymer, a polyester-based polymer, and a polyurethane-based polymer. Among them, preferable is the vinyl-based polymer.

The vinyl-based polymer is preferably a polymer obtained by copolymerizing a monomer composition containing (a) one or more vinyl-based monomers selected from the group consisting of ester acrylate, ester methacrylate, and a styrene-based monomer; (b) a polymerizable unsaturated monomer containing a salt-forming group; and (c) a component copolymerizable with the vinyl-based monomers and the polymerizable unsaturated monomer containing a salt-forming group.

Examples of the vinyl-based monomers in (a) include ester acrylates such as methyl acrylate, ethyl acrylate, isopropyl acrylate, n-butyl acrylate, t-butyl acrylate, isobutyl acrylate, n-amyl acrylate, n-hexyl acrylate, n-octyl acrylate, and dodecyl acrylate; ester methacrylates such as methyl methacrylate, isopropyl methacrylate, n-butyl methacrylate, t-butyl methacrylate, isobutyl methacrylate, n-amyl methacrylate, 2-ethylhexyl methacrylate, and lauryl methacrylate; styrene-based monomers such as styrene, vinyltoluene, and 2-methyl styrene. There may be used alone or in combination.

Examples of the polymerizable unsaturated monomer containing a salt-forming group in (b) include a cationic monomer containing a salt-forming group, and an anionic monomer containing a salt-forming group.

Examples of the cationic monomer containing a salt-forming group include a tertiary amine-containing unsaturated monomer and an ammonium salt-containing unsaturated monomer. Preferable examples thereof include N,N-dimethylaminoethyl acrylate, N—(N',N'-dimethylaminoethyl)acrylamide, vinyl pyridine, 2-methyl-5-vinylpyridine, dimethylaminoethyl methacrylate, and diethylaminoethyl methacrylate.

Examples of the anionic monomer containing a salt-forming group include an unsaturated carboxylate monomer, an unsaturated sulfonate monomer, and an unsaturated phosphate monomer. Preferable examples thereof include acrylic acid, methacrylic acid, itaconic acid, maleic acid, and fumaric acid.

Examples of the component copolymerizable with the vinyl-based monomers and the polymerizable unsaturated monomer containing a salt-forming group in (c) include an acrylic amide-based monomer, a methacrylic amide-based monomer, a hydroxyl group-containing monomer, and a macromer containing one terminal polymerizable functional group.

The macromer containing one terminal polymerizable functional group is not particularly limited and may be appropriately selected depending on the intended purpose. Examples thereof include a silicone macromer, a styrene-based macromer, a polyester-based macromer, a polyurethane-based macromer, a polyalkylether macromer, a macromer represented by General Formula: $CH_2{=}C(R^5)COO(R^6O)_pR^7$ (where $R^5$ denotes a hydrogen atom or a lower alkyl group, $R^6$ denotes a C1 to C30 divalent hydrocarbon group which may contain a hetero atom, $R^7$ denotes a hydrogen atom or a C1 to C30 monovalent hydrocarbon group which may contain a hetero atom, and p denotes an integer of 1 to 60). These may be used alone or in combination.

Example of the lower alkyl group includes a C1 to C4 alkyl group.

Examples of the hydroxyl group-containing monomer include 2-hydroxyethyl acrylate and 2-hydroxyethyl methacrylate.

Preferable examples of the macromer represented by the general formula: $CH_2{=}C(R^5)COO(R^6O)_pR^7$ include polyethylene glycol (2 to 30) (meth)acrylate and methoxypolyethylene glycol (1 to 30) (meth)acrylate. Notably, as used herein, the term "(meth)acrylate" means acrylate or methacrylate.

Among the copolymerizable components, the macromers are preferable, and the silicone-based macromer, the styrene-based macromer, and the polyalkylether macromer are more preferable.

An amount of the vinyl-based monomer contained in the monomer composition is not particularly limited and may be appropriately selected depending on the intended purpose, but is preferably 1% by mass to 75% by mass, more preferably 5% by mass to 60% by mass, particularly preferably 10% by mass to 50% by mass, from the viewpoint of improving dispersion stability of polymer emulsion.

An amount of the polymerizable unsaturated monomer containing a salt-forming group contained in the monomer composition is not particularly limited and may be appropriately selected depending on the intended purpose, but is preferably 2% by mass to 40% by mass, more preferably 5% by mass to 20% by mass, from the viewpoint of improving dispersion stability of polymer emulsion.

An amount of the monomer copolymerizable with the vinyl-based monomer and the polymerizable unsaturated monomer containing a salt-forming group contained in the monomer composition is not particularly limited and may be appropriately selected depending on the intended purpose, but is preferably 5% by mass to 90% by mass, more preferably 10% by mass to 85% by mass, particularly preferably 20% by mass to 60% by mass, from the viewpoint of improving dispersion stability of polymer emulsion.

An amount of the polymer particles is preferably 10% by mass to 40% by mass.

An average particle diameter of the polymer particles is preferably 20 nm to 200 nm from the viewpoint of dispersion stability.

The average particle diameter refers, for example, to a 50% average particle diameter (D50) measured on a sample which is diluted with pure water to a pigment concentration of 0.01% by mass, using MICROTRAC UPA-150 (manufactured by NIKKISO CO., LTD.) at 23° C. under the conditions of a particle refractive index of 1.51, a particle density of 1.4 g/cm$^3$ and a pure water parameter as a solvent parameter.

<<Surfactant>>

Preferable surfactants are those having low surface tension, high penetrability, and high leveling property without impairing dispersion stability of the colorant depending on types of the colorant or combinations with the water-soluble organic solvent.

The surfactant is preferably at least one selected from the group consisting of an anionic surfactant, a nonionic surfactant, a silicone surfactant, and a fluorosurfactant. Among them, the silicone surfactant and the fluorosurfactant are particularly preferable. These surfactants may be used in combination.

The fluorosurfactant are preferably those in which 2 to 16 carbon atoms are substituted with fluorine atoms, more preferably those in which 4 to 16 carbon atoms are substituted with fluorine atoms. When 2 to 16 carbon atoms are substituted with fluorine atoms, fluorine can exhibit its function and ink storability is good.

Examples of the fluorosurfactant include a perfluoroalkyl sulfonic acid compound, a perfluoroalkyl carboxylic acid compound, a perfluoroalkyl phosphate ester compound, perfluoroalkyl ethylene oxide adduct, and a polyoxyalkylene ether polymer compound containing a perfluoroalkyl ether group in a side chain thereof. Among them, particularly preferable is the polyoxyalkylene ether polymer compound containing a perfluoroalkyl ether group in a side chain thereof from the viewpoint of low foamability.

Further preferable fluorosurfactant is a fluorosurfactant represented by the following General Formula (I):

$$C_nF_{2n+1}{-}CH_2CH(OH)CH_2{-}O{-}(CH_2CH_2O)_a{-}Y' \quad \text{General Formula (I)}$$

In the general formula (I), n denotes an integer of 2 to 6, a denotes an integer of 15 to 50, and Y' denotes $-C_bH_{2b+1}$ (where b denotes an integer of 11 to 19) or $-CH_2CH(OH)CH_2{-}C_dF_{2d+1}$ (where d denotes an integer of 2 to 6).

The fluorosurfactant may be appropriately synthesized, or may be commercially available products. Examples of the commercially available products include FS-300 (manufactured by Du Pont Kabushiki Kaisha), FT-110, FT-250, FT-251, FT-400S, FT-150, and FT-400SW (manufactured by NEOS COMPANY LIMITED), and POLYFOX PF-151N (manufactured by Omnova Solutions, Inc.) because these can achieve good printing quality, particularly color developability, and can significantly improve uniform dye-affinity for paper.

Suitable specific examples of the fluorosurfactant include those shown below:

(1) Anionic Fluorosurfactant

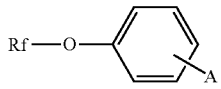

In the above formula, Rf denotes a mixture of fluorine-containing hydrophobic groups represented by the following formula; and A denotes —$SO_3X$, —COOX, or —$PO_3X$ (where X denotes a counter anion, specifically a hydrogen atom, Li, Na, K, $NH_4$, $NH_3CH_2CH_2OH$, $NH_2(CH_2CH_2OH)_2$, and $NH(CH_2CH_2OH)_3$).

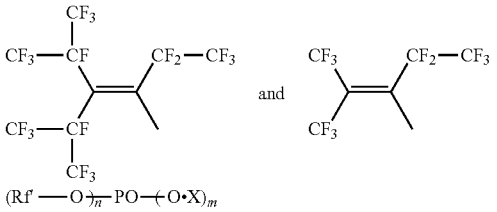

In the above formula, Rf denotes a fluorine-containing group represented by the following formula, X denotes the same as described above, n denotes an integer of 1 or 2, and m denotes 2-n.

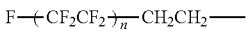

In the above formula, n denotes an integer of 3 to 10.

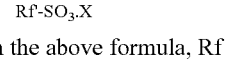

In the above formula, Rf and X each denotes the same as described above.

In the above formula, Rf and X each denotes the same as described above.

(2) Nonionic Fluorosurfactant

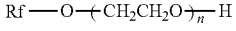

In the above formula, Rf denotes the same as described above, and n denotes an integer of 5 to 20.

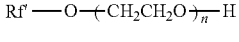

In the above formula, Rf denotes the same as described above, and n denotes an integer of 1 to 40.

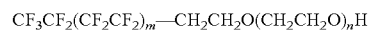

In the above formula, m denotes an integer of 0 to 10, and n denotes an integer of 0 to 40.

(3) Amphoteric Fluorosurfactant

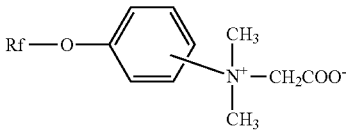

In the above formula, Rf denotes the same as described above.

(4) Oligomer Fluorosurfactant

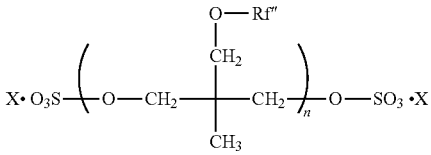

In the above formula, Rf" denotes a fluorine-containing group represented by the following formula, n denotes an integer of 1 to 10, and X denotes the same as described above.

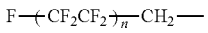

In the above formula, n denotes an integer of 1 to 4.

The silicone surfactant is not particularly limited and may be appropriately selected depending on the intended purpose, but is preferably those are not decomposed at a high pH. Examples of the silicone surfactant include side chain-modified polydimethylsiloxane, both terminal-modified polydimethylsiloxane, one terminal-modified polydimethylsiloxane, and side chain and both terminal-modified polydimethylsiloxane. A polyether-modified silicone surfactant having, as a modified group, a polyoxyethylene group or a polyoxyethylene polyoxypropylene group is particularly preferable because it exhibits excellent properties as an aqueous surfactant.

The surfactants may be appropriately synthesized, or may be commercially available products. The commercially available products may be easily available from, for example, BYK Japan Shin-Etsu Chemical Co., Ltd., and Dow Corning Toray Co., Ltd.

The polyether-modified silicone surfactant is not particularly limited and may be appropriately selected depending on the intended purpose. Examples thereof include a compound represented by the following general formula in which a polyalkylene oxide structure is introduced to a side chain branched from Si of dimethyl polysiloxane.

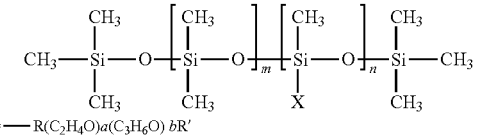

In the general formula, m, n, a, and b each independently denotes an integer, and R and R' each independently denotes an alkyl group, or an alkylene group.

The polyether-modified silicone surfactant may be appropriately synthesized products or commercially available products. Examples of the commercially available products include KF-618, KF-642, and KF-643 (all manufactured by Shin-Etsu Chemical Co., Ltd.), and BYK-345, BYK-347, BYK-348, and BYK-349 (all manufactured by BYK-Chemie GmbH).

Examples of the anionic surfactant include polyoxyethylene alkyl ether acetate, dodecylbenzene sulfonate, laurate, and polyoxyethylene alkyl ether sulfate.

The anionic surfactant may be appropriately synthesized products or commercially available products. Example of the commercially available products include sodium polyoxyethylene(3)tridecyl ether acetate (ECTD-3NEX, manufactured by Nikko Chemicals Co., Ltd.).

Examples of the nonionic surfactant include polyoxyethylene alkyl ether, polyoxypropylene polyoxyethylene alkyl ether, polyoxyethylene alkyl ester, polyoxyethylene sorbitan fatty acid ester, polyoxyethylene alkylphenyl ether, polyoxyethylene alkylamine, and polyoxyethylene alkylamide.

An amount of the surfactant is not particularly limited and may be appropriately selected depending on the intended purpose, but preferably 0.01% by mass to 3.0% by mass, more preferably 0.03% by mass to 2.0% by mass, relative to the total amount of the ink. When the amount falls within 0.01% by mass to 3.0% by mass, the surfactant may exhibit its effects sufficiently, the resulting ink may moderately penetrate into a recording medium, and reduction in the image density of the resulting image or strike through can be prevented, which are advantageous.

<<Water-Soluble Organic Solvent>>

A water-soluble organic solvent is added to the ink in order to prevent drying and improve dispersion stability.

Examples of the water-soluble organic solvent include polyhydric alcohols, polyhydric alcohol alkyl ethers, polyhydric alcohol aryl ethers, nitrogen-containing heterocyclic compounds, amides, amines, sulfur-containing compounds, propylene carbonate, and ethylene carbonate. These may be used alone or in combination.

Examples of the polyhydric alcohols include ethylene glycol, diethylene glycol, triethylene glycol, tetraethylene glycol, polyethylene glycol, propylene glycol (1,2-propanediol), dipropylene glycol, tripropylene glycol, polypropylene glycol, 1,2-butanediol, 1,3-butanediol, 3-methyl-1,3-butanediol, 1,5-pentanediol, 1,6-hexanediol, glycerin, trimethylol ethane, trimethylol propane, 1,2,3-butanetriol, 1,2,4-butanetriol, 1,2,6-hexanetriol, and petriol.

Examples of the polyhydric alcohol alkyl ethers include ethyleneglycol monoethylether, ethyleneglycol monobutylether, diethyleneglycol monomethylether, diethyleneglycol monoethylether, diethyleneglycol monobutylether, tetraethyleneglycol monomethylether, and propyleneglycol monoethylether.

Examples of the polyhydric alcohol aryl ethers include ethylene glycol monophenyl ether, and ethylene glycol monobenzyl ether.

Examples of the nitrogen-containing heterocyclic compounds include 2-pyrrolidone, N-methyl-2-pyrrolidone, N-hydroxyethyl-2-pyrrolidone, 1,3-dimethylimidazolidinone, ϵ-caprolactam, and γ-butyrolactone.

Examples of the amides include formamide, N-methylformamide, and N,N-dimethylformamide.

Examples of the amines include monoethanol amine, diethanol amine, triethanol amine, monoethylamine, diethylamine, and triethylamine.

Examples of the sulfur-containing compounds include dimethyl sulfoxide, sulfolane, and thiodiethanol.

In addition to the water-soluble organic solvent, other wetting agents may be used. Examples of the wetting agent include those containing a urea compound or saccharides. Examples of the saccharides include monosaccharides, disaccharides, oligosaccharides (including trisaccharides, and tetrasaccharides), and polysaccharides. Specific examples thereof include glucose, mannose, fructose, ribose, xylose, arabinose, galactose, maltose, cellobiose, lactose, sucrose, trehalose, and maltotriose. Here, the above-mentioned polysaccharides mean saccharides in a broad sense, which may include materials existing widely in nature, such as α-cyclodextrin and cellulose.

Moreover, examples of derivatives of the saccharides include reducing sugars of the saccharides (e.g., sugar alcohol represented by the following general formula: $HOCH_2(CHOH)_nCH_2OH$, where n denotes an integer of 2 to 5), oxidized sugars of the saccharides (e.g., aldonic acids and uronic acids), amino acids, and thio acids. Among these, the sugar alcohol is preferable.

Specific examples of the sugar alcohol include D-sorbitol, sorbitan, maltitol, erythritol, lactitol, and xylitol.

From the viewpoint of producing the ink excellent in storage stability and ejection stability, the water-soluble organic solvent is preferably glycerin, diethylene glycol, triethylene glycol, propylene glycol (1,2-propanediol), dipropylene glycol, 1,3-butanediol, 1,2-butanediol, 3-methyl-1,3-butanediol, 1,5-pentanediol, 1,6-hexanediol, trimethylol propane, tetramethylol propane, D-sorbitol, and xylitol, with glycerin, 3-methyl-1,3-butanediol, 1,3-butanediol, 1,2-butanediol, propylene glycol (1,2-propanediol), 1,6-hexanediol, 1,5-pentanediol, and 2-pyrrolidone being more preferable.

In the case of a pigment ink, a mass ratio between the pigment and the water-soluble organic solvent largely affects ejection stability of the ink from a head. When the ink has a high solid content of the pigment and a small amount of the water-soluble organic solvent, moisture evaporates in proximity to an ink meniscus of a nozzle, potentially leading to ejection failures.

An amount of the water-soluble organic solvent contained in the ink is not particularly limited and may be appropriately selected depending on the intended purpose, but preferably 10% by mass to 50% by mass relative to the total amount of the ink.

<<Water>>

The water may be, for example, pure water such as ion-exchanged water, ultrafiltered water, reverse osmosis water, and distilled water, or ultrapure water.

An amount of the water is not particularly limited and may be appropriately selected depending on the intended purpose.

<<Other Components>>

The other components are not particularly limited and may be appropriately selected depending on the intended purpose. Examples thereof include a foam inhibitor (a defoaming agent), a pH regulator, an antiseptic-antifungal agent, an anti-rust agent, a chelating agent, and a penetrating agent.

The foam inhibitor (defoaming agent) is added to prevent foaming of the ink or to break generated bubbles. Examples of the foam inhibitor (defoaming agent) include those represented by the following general formula:

$$HOR_1R_3C—(CH_2)_m—CR_2R_4OH$$

In the above general formula, $R_1$ and $R_2$ each independently denotes a C3-C6 alkyl group; $R_3$ and $R_4$ each independently denotes a C1-C2 alkyl group; and m denotes an integer of 1 to 6.

Among the compounds represented by the above general formula, 2,4,7,9-tetramethyldecane-4,7-diol is preferable from the viewpoint of an excellent foam inhibiting effect.

The defoaming agent is preferably a silicone defoaming agent. Examples of the silicone defoaming agent include an oil-type silicone defoaming agent, a compound-type silicone defoaming agent, a self-emulsifying-type silicone defoaming agent, an emulsion-type silicone defoaming agent, and a modified silicone defoaming agent.

The defoaming agent may be a commercially available product. Examples of the commercially available product include silicone defoaming agents manufactured by Shin-Etsu Chemical Co., Ltd. (e.g., KS508, KS531, KM72, KM72F, KM85, and KM98), silicone defoaming agents manufactured by Dow Corning Toray Co., Ltd. (e.g., Q2-3183A, SH5500, SH5510, SM5571, and SM5571 EMULSION), silicone defoaming agents manufactured by NUC Corporation (e.g., SAG30), and defoaming agents manufactured by ADEKA Co., Ltd. (e.g., ADEKANATE series).

The pH regulator is added to stabilize a dispersion state, and thus ejection by keeping the ink in an alkaline state. However, when the pH of the ink is 11 or more, the ink dissolves a recording head and an ink supplying unit in a large amount. Therefore, depending on a material of the head and unit, problems such as deterioration, leakage, and ejection failure of the ink tend to occur after using for a long period of time. When a pigment is used as the colorant of the ink, an addition of the pH regulator at the time when the pigment and a dispersing agent are kneaded and dispersed in water is more preferable than an addition of the pH regulator along with other additives such as the wetting agent and the penetrating agent after the pigment and the dispersing agent are kneaded and dispersed. This is because the pH regulator may agglomerate the pigment dispersion depending on properties of the pH regulator.

The pH regulator preferably contains one or more of alcohol amines, alkali metal hydroxides, ammonium hydroxides, phosphonium hydroxides, and alkali metal carbonates.

Examples of the alcohol amines include diethanol amine, triethanol amine, and 2-amino-2-ethyl-1,3-propanediol.

Examples of the alkali metal hydroxides include lithium hydroxide, sodium hydroxide, and potassium hydroxide.

Examples of the ammonium hydroxides include ammonium hydroxide, and quaternary ammonium hydroxide.

Examples of the phosphonium hydroxides include quaternary phosphonium hydroxide.

Examples of the alkali metal carbonates include lithium carbonate, sodium carbonate, and potassium carbonate.

Examples of the antiseptic-antifungal agent include sodium dehydroacetate, sodium sorbate, sodium 2-pyridinethiol-1-oxide, sodium benzoate, and sodium pentachlorophenol.

Examples of the anti-rust agent include acidic sulfite, sodium thiosulfate, ammonium thiodiglycolate, diisopropyl ammonium nitrate, pentaerythritol tetranitrate, and dicyclohexyl ammonium nitrate.

Examples of the chelating agent include sodium ethylenediamine tetraacetate, sodium nitrilotriacetate, sodium hydroxyethylethylenediamine triacetate, sodium diethylenetriamine pentaacetate, and sodium uramil diacetate.

Examples of the penetrating agent include a C7 to C11 diol compound. Examples of the C7 to C11 diol compound include 2-ethyl-1,3-hexanediol, and 2,2,4-trimethyl-1,3-pentanediol.

An amount of the penetrating agent contained in the ink is preferably 1% by mass to 5% by mass relative to the total amount of the ink from the viewpoint of storage stability.

A viscosity of the ink is not particularly limited and may be appropriately selected depending on the intended purpose, but is preferably 3 mPa·s to 20 mPa·s, more preferably 6 mPa·s to 12 mPa·s at 25° C., which results in more excellent ejection stability and image quality.

<Ink Set>

An ink used for an inkjet recording method of the present invention is preferably an ink set meeting the following requirements (1) to (3), in addition to the monochrome inks:

(1) The ink set is composed of a black ink and other one or more inks.

(2) Each ink has the static surface tension of 18.0 mN/m to 27.0 mN/m at 25° C., and the receding contact angle on the nozzle plate is less than 50°.

(3) A difference in the static surface tension between the black ink and the other color ink or each of the other color inks [(black ink)−(the other color ink or each of the other color inks)] is 0 mN/m to 4 mN/m at 25° C.

An ink having a low static surface tension of 18.0 mN/m to 27.0 mN/m at 25° C. wets and spreads on a recording medium well and rapidly penetrates into the recording medium after the ink is impacted on the recording medium. Accordingly, the ink tends to achieve excellent color development and high image quality. However, the ink easily wets and spreads also on a surface of the nozzle plate in the liquid ejection head, making it difficult to ensure continuous ejection stability.

The ink having the receding contact angle on the nozzle plate of less than 50° is hardly released from the surface of the nozzle plate. That is, when the ink overflows onto the surface of the nozzle plate, the overflowed ink droplets are released from the surface even by being pulled by the subsequently ejected droplets, which is disadvantageous for the ejection stability.

Therefore, the ink which is spread to far away from the nozzle opening disadvantageously remains on the surface of the nozzle plate. As a result, the residual ink gradually accumulates, which finally adversely affects the ejection of the ink droplets.

Even when the ink droplets are spread to far away from the nozzle opening as described above, the two-step pull pulse which pulls the ink into the nozzle in the two-step manner within the one printing unit cycle can pulls the ink located in proximity to the nozzle outlet into the nozzle two times to thereby form the meniscus at the predetermined position. Therefore, almost all of the overflowed ink droplets are pulled. As a result, the ejection is less adversely affected by the overflowed ink droplets (e.g., deflection of the droplets ejection) and an excellent image can be obtained.

The ink used for an inkjet recording method of the present invention is preferably an ink set composed of a black ink and one or more other inks.

The static surface tension is related to a penetration process of the inks in the ink set into a recording medium. Therefore, in the case where a plurality colors of inks is used to form a color image, the inks differentially penetrate into the recording medium at an area at which difference colors are in contact with each other due to the difference in the static surface tension, leading to deterioration of image quality.

In particular, a black ink is excellent in visibility, so that even a thin line or a contour of dot can be clearly visible, but image disturbance tends to be prominent. For example, in the case where a dot of the black ink having high penetrability (i.e., low static surface tension) is in contact with a dot of other color ink having low penetrability (i.e., high static surface tension), the black ink is pulled toward the other color inks having high static surface tension. As a result, the black ink is mixed into the other color ink to cause a blurred contour therebetween. This is a so-called bleed phenomenon. The bleed phenomenon easily occurs especially on a recording medium having low penetrability, and in high-speed printing in which a sufficiently long penetration time is not ensured.

The bleed phenomenon can be prevented by raising the static surface tension of the black ink, and lowering the static surface tension of the other color ink. However, when the difference in the static surface tension between the black ink and the other color ink is too large, the another ink is pulled toward and mixed into the black ink, so that black characters may be thinned or the bleed may be occurred at a boundary portion, leading to deterioration of image quality.

In contrast, when the difference in the static surface tension is small, no or only slight bleed occurs. Additionally, even when the bleed occurs, the other color ink is pulled toward the black ink having lower brightness than the other color ink, which has only a small affect on image quality. The present inventors have focused on the above, and solve the bleed problem by setting the static surface tension of the black ink at 25° C. to be 0 mN/m to 4 mN/m higher than that of the other color ink.

According to the inkjet recording method of the present invention using the ink set, even when the water-repellent film is gradually deteriorated due to a physical load applied during a maintenance work for keeping a surface of the nozzle plate on which the nozzle constituting the droplet ejection head is formed clean, the ink set including a black and other one or more colors and having a low static surface tension (18.0 mN/m to 27.0 mN/m at 25° C.) and a small receding contact angle (less than 50° on the nozzle plate) can be ejected stably (ejection stability: no streak, white void, or jetting disturbance in a solid area), and good image (uniformity in a solid area, and no bleed between the black ink and other color inks) can be obtained.

Each of inks included in the ink set preferably contains water, a water-soluble organic solvent, a colorant, and a surfactant; and, if necessary, further contains other components.

The water, the water-soluble organic solvent, the colorant, the surfactant, and the other components contained in each of inks in the ink set may be the same as in the ink.

<Colorization>

Each of inks in the ink set composed of a black ink and other one or more inks used in the present invention is not particularly limited and may be appropriately selected depending on the intended purpose. Examples thereof include a yellow ink, a magenta ink, and a cyan ink. An ink set containing two or more of these inks can be used for recording to thereby form a multicolor image. An ink set containing all of these inks can be used for recording to thereby form a full color image.

<Ink Cartridge>

An ink cartridge used in the present invention is an ink cartridge in which a container houses an ink or each ink in an ink set used in an inkjet recording method of the present invention. That is, the ink cartridge includes a container and an ink housed in the container; and, if necessary, further includes appropriately selected other members.

The container is not particularly limited, and a shape, structure, size, and material thereof may be appropriately selected depending on the intended purpose. For example, example of the container includes those having an ink bag formed of a plastic container or an aluminum laminate film.

Figure 22:
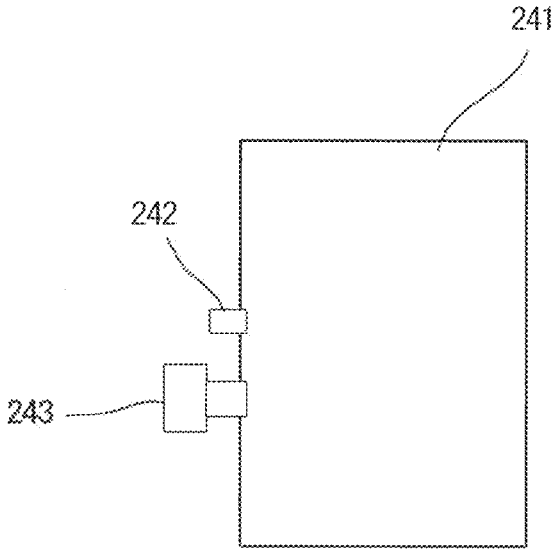
FIG. 22 is a schematic diagram illustrating one exemplary ink cartridge.
Figure 23:
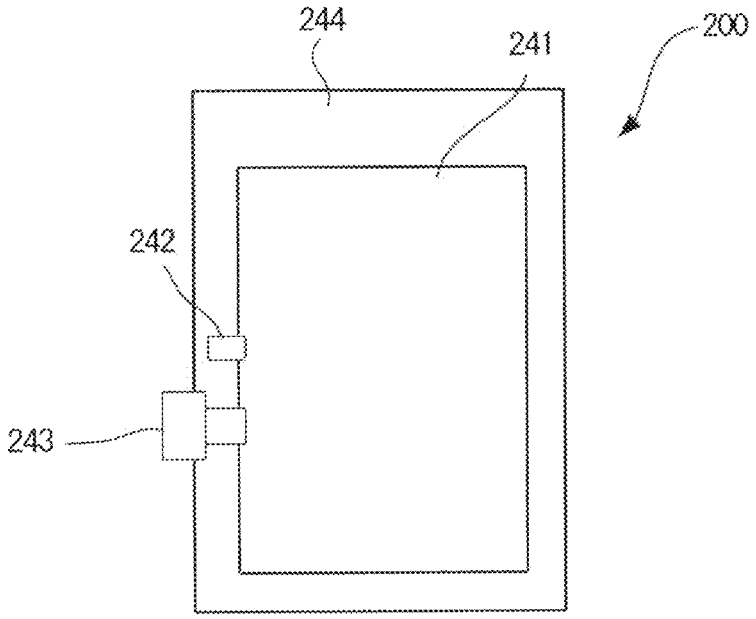
FIG. 23 is a schematic diagram illustrating the ink cartridge including a case shown in FIG. 22.

Specific examples of the ink cartridge include those having a configuration shown in FIG. 22 or 23. FIG. 22 shows an example of an ink cartridge. FIG. 23 shows an ink cartridge shown in FIG. 22 including a case (housing).

An ink bag 241 is filled with an ink by injecting the ink from an ink inlet 242, and evacuated. Then, the ink inlet 242 is sealed by fusing. At the time of use, a needle equipped in a device main body is inserted into an ink outlet 243 formed of a rubber member to thereby supply the ink to the device main body. The ink bag 241 is formed of a wrapping member such as an air non-permeable aluminum laminate film. As illustrated in FIG. 23, the ink bag 241 is typically housed in a plastic cartridge case 244, which is then detachably mounted in various inkjet recording devices as an ink cartridge 240.

The ink cartridge houses therein the ink or each ink of the ink set, and can be detachably mounted in various inkjet recording devices, particularly preferably detachably mounted to the inkjet recording device described below.

Next, an inkjet recording method and an inkjet recording device of the present invention are described below with reference to the accompanying drawings.

Figure 13:
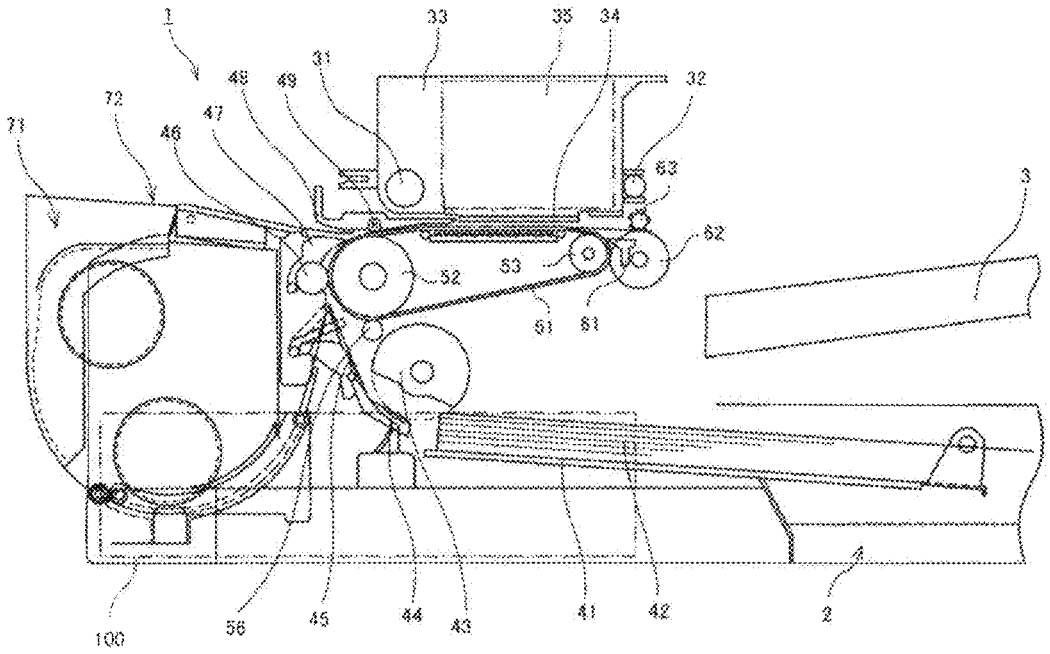
FIG. 13 is a side view illustrating one exemplary entire configuration of an inkjet recording device of the present invention.
Figure 14:
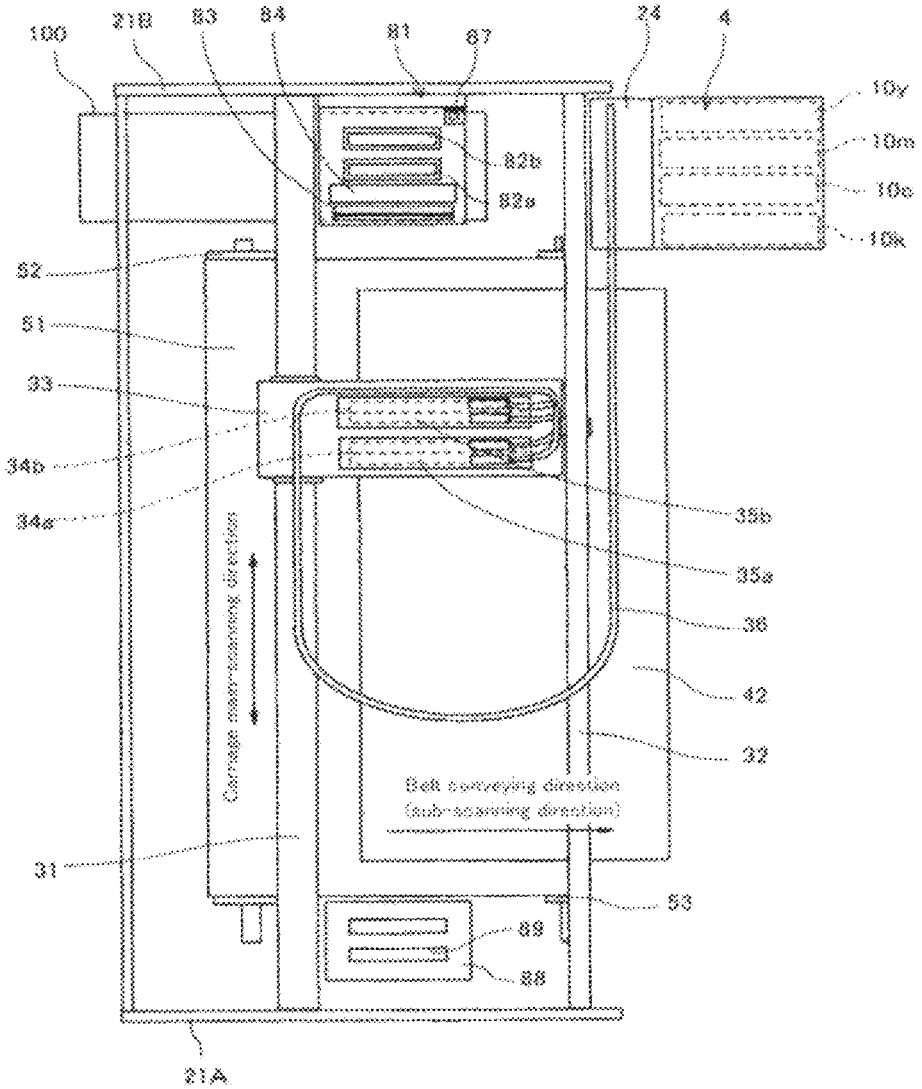
FIG. 14 is a plan view of essential parts illustrating one exemplary an entire configuration of an inkjet recording device of the present invention.

A one example of the inkjet recording device of the present invention is described with reference to FIGS. 13 and 14. FIG. 13 is a side view of the inkjet recording device illustrating its entire configuration, and FIG. 14 is a plan view of the inkjet recording device illustrating its major components.

The inkjet recording device is a serial-type inkjet recording device. In the inkjet recording device, a carriage 33 is supported on a main guide rod 31 and a sub guide rod 32 serving as guide members laterally bridged to the side plates 21A and 21B located one at each side of a main body 1 so as to be slidable in a main-scanning direction, and moved to scan in a direction indicated by an arrow in FIG. 14 (carriage main scanning direction) via a timing belt by a main scanning motor (not shown).

On the carriage 33 are mounted recording heads 34*a* and 34*b* (collectively referred to as "recording heads 34" unless distinguished) serving as liquid ejection heads for ejecting ink droplets of different colors, e.g., yellow (Y), cyan (C), magenta (M), and black (K) so that nozzle arrays of multiple nozzles are arranged in a sub-scanning direction perpendicular to the main scanning direction and ink droplets are ejected downward from the nozzles.

For example, each of the recording heads 34 has two nozzle arrays. In such a case, for example, one of the nozzle arrays of the recording head 34*a* ejects droplets of black (K) ink and the other ejects droplets of cyan (C) ink. In addition, one of the nozzle arrays of the recording head 34*b* ejects droplets of magenta (M) ink and the other ejects droplets of yellow (Y) ink. Note that, the recording head 34 may include a surface of a nozzle having plural nozzle arrays of respective colors.

On the carriage 33 are mounted sub tanks 35*a* and 35*b* (collectively referred to as "sub tanks 35" unless distinguished) as a second ink supplying section to supply respective colors of ink to the corresponding nozzle arrays of the recording head 34. The sub tank 35 is supplied with respective colors of recording liquid via supply tubes 36 for corresponding colors by a supply pump unit 24 from ink cartridges (main tanks) of respective colors 10*y*, 10*m*, 10*c*, and 10*k* that are detachably attached to a cartridge application section 4.

The inkjet recording device further includes a separation pad 44 as a paper feeding section for feeding sheets of paper 42 accumulated on a sheet accumulating section (pressure plate) 41 of a paper feeding tray 2. The separation pad 44 is directed to face a semicircular roller (paper feeding roller) 43 and a paper feeding roller 43 configured to separate and feed one sheet 42 at a time from the sheet accumulating section 41, made of a material having a high friction coefficient, and biased toward the paper feeding roller 43 side.

The inkjet recording device further includes a guide member 45 configured to guide the sheets of paper 42, a counter roller 46, a conveyance guide 47, and a pressing member 48 including a front end-pressing roller 49 in order to transfer the sheets of paper 42 fed from the paper-feeding section to a lower side of the recording head 34. The inkjet recording device also includes a conveyance belt 51 serving as a conveying means configured to electrostatically adsorb the sheet of paper 42 to convey the sheet of paper to a position facing the recording head 34.

The conveyance belt 51 is an endless belt looped over a conveyance roller 52 and a tension roller 53 so as to rotationally travel in a belt conveying direction (sub-scanning direction). The inkjet recording device further includes a charging roller 56 serving as a charging unit configured to charge a surface of the conveyance belt 51. The charging roller 56 is arranged so as to be brought into contact with a surface layer of the conveyance belt 51 and be rotationally driven by the rotation of the conveyance belt 51. The conveyance belt 51 is caused to rotationally travel in the belt conveying direction illustrated in FIG. 14 by the transfer roller 52 that is rotationally driven by a sub-scanning motor (not shown) via the timing belt.

The inkjet recording device further includes, as a paper ejection section configured to eject the sheet of paper 42 on which an image has been formed by the recording heads 34, a separation claw 61 for separating the sheet of paper 42 from the conveyance belt 51, a paper ejection roller 62, a spur (paper ejection roller) 63, and a paper ejection tray 3 located below the paper ejection roller 62.

The inkjet recording device also includes a duplex printing unit 71 detachably mounted at the back of the main body 1. The duplex printing unit 71 captures the sheet of paper 42 rotationally conveyed in a reverse direction of the conveyance belt 51, reverses the sheet of paper, and then re-feeds the reversed sheet of paper between the counter roller 46 and the conveyance belt 51. At the top face of the duplex printing unit 71 is formed a manual feed tray 72.

The inkjet recording device further includes a retaining-recovery mechanism 81 for retaining and recovering the nozzle states of the recording head 34 in a non-printing region at one side of the carriage 33 in the scanning direction. The retaining-recovery mechanism 81 includes cap members (hereinafter referred to as "caps") 82*a* and 82*b* (collectively referred to as "caps 82" unless distinguished) for capping the surface of the nozzle plate of the recording head 34, a wiper member (wiper blade) 83 for wiping the surface of the nozzle plate, a spitting receiver 84 for receiving droplets which do not contribute to image recording spitted to remove a thickened recording liquid, and a carriage lock 87 for locking the carriage 33. The inkjet recording device also includes a waste tank 100 replaceably mounted at a lower side of the retaining-recovery mechanism 81 of the recording head to store waste liquid ejected by retaining-recovery operations.

The recording apparatus further includes a non-recording liquid ejection receiver 88 in a non-printing region at the other side of the carriage 33 in the carriage main-scanning direction so as to receive the non-recording liquid when the recording liquid is thickened and thus ejected. The non-recording liquid ejection receiver 88 includes an opening 89 along the nozzle array direction of the recording head 34.

In the inkjet recording device having the above configuration, the sheet of paper 42 is separated from those others in the paper feeding tray 2, and then fed in a substantially vertically upward direction. Then, the sheet of paper is guided by the guide member 45, and conveyed with being sandwiched between the conveyance belt 51 and the counter roller 46. The front end of the sheet of paper is guided by the conveyance guide 47, and pressed against the conveyance belt 51 by the front end-pressing roller 49, by which the conveyance direction thereof is changed by approximately 90°.

At this time, voltages are applied to the charging roller 56 so that plus outputs and minus outputs are alternately repeated. As a result, the conveyance belt 51 is charged in an alternating voltage pattern. When the sheet of paper 42 is fed onto the charged conveyance belt 51, the sheet of paper 42 is adsorbed onto the conveyance belt 51 and then conveyed in the sub-scanning direction by the rotational movement of the conveyance belt 51.

By driving the recording heads 34 in accordance with image signals while moving the carriage 33, ink droplets are ejected onto the stationary sheet of paper 42 to thereby record one line of a desired image. The sheet of paper 42 is then conveyed by a predetermined distance, and the next line of image is recorded on the sheet of paper. When a recording end signal a signal indicating that the rear end of the sheet of paper 42 has reached the recording region is received, the recording operation is terminated and the sheet 42 is ejected to the paper ejection tray 3.

To perform a retaining-recovery operation of the nozzles of the recording head 34, the carriage 33 is moved to a home position facing the retaining-recovery mechanism 81, where the retaining-recovery operations are carried out including nozzle suctioning in which the nozzles are capped with the caps 82 and then the ink is suctioned from the nozzle, and spitting in which droplets which do not contribute to the image formation are ejected. As a result, the ink droplets are stably ejected to form an image.

Figure 15:
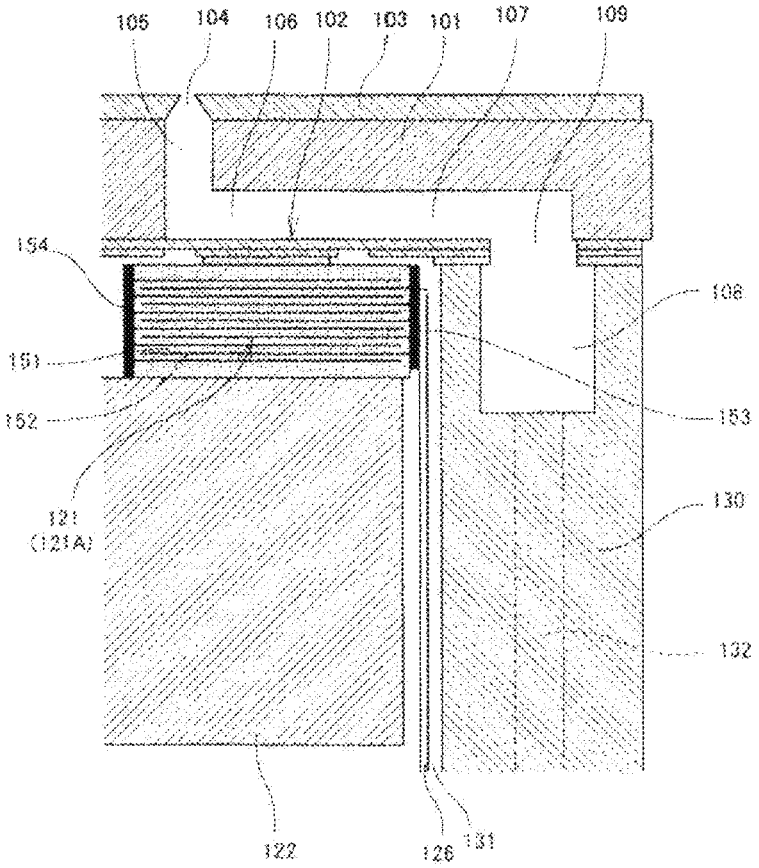
FIG. 15 is a cross-sectional diagram along a longitudinal direction of a liquid chamber illustrating one exemplary liquid ejecting head constituting a recording head of an inkjet recording device of the present invention.
Figure 16:
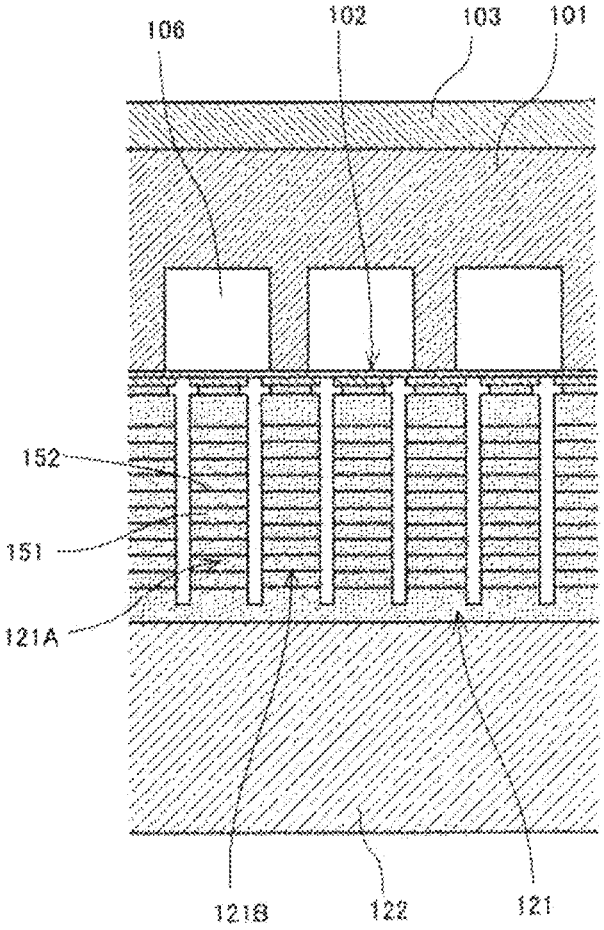
FIG. 16 is a cross-sectional diagram along a transverse direction of a liquid chamber illustrating one exemplary liquid ejecting head constituting a recording head of an inkjet recording device of the present invention.

Next, an example of a liquid ejecting head constituting the recording head 34 is described with reference to FIGS. 15 and 16. Note that FIG. 15 is a cross sectional view along a longitudinal direction of a liquid chamber of the head, and FIG. 16 is a cross sectional view along a transverse direction (nozzle arrangement direction) of the liquid chamber of the head.

The liquid ejection head includes a flow channel plate 101, an oscillation plate 102 joined to a lower surface of the flow channel plate 101, and a nozzle plate 103 joined to an upper surface of the flow channel plate 101 The flow channel plate, the oscillation plate, and the nozzle plate are arranged in a layer to thereby form a nozzle communication path 105 which is a flow channel in communication with the nozzles 104 configured to eject liquid droplets (ink droplets), the pressurizing liquid chamber 106 serving as a pressure generating chamber, and an ink supply port 109 which is in communication with a common liquid chamber 108 configured to supply ink to the pressurizing liquid chamber 106 via a fluid resistor section (fluid supply path) 107.

The liquid ejection head further includes two (only one shown in FIG. 15) stacked piezoelectric members 121 serving as an electromechanical transducer which is the pressure generating unit (actuator unit) configured to deform the oscillation plate 102 to thereby pressurize the ink in the pressurizing liquid chamber 106, and a base substrate 122 to which the piezoelectric members 121 are joined and fixed. The piezoelectric members 121 form a plurality of piezoelectric element columns 121A and 121B, which are formed by forming grooves through a slit processing in which the piezoelectric members are not divided. In this example, the piezoelectric element column 121A is used as a driving piezoelectric element column that applies chive waveforms, and the piezoelectric element column 121B is used as a non-driving piezoelectric element column that does not apply the drive waveforms. A FPC cable 126 having a drive circuit (drive IC) (not shown) is connected to the piezoelectric element columns 121A of the piezoelectric members 121.

A periphery of the oscillation plate 102 is joined to a frame member 130. The frame member 130 includes a through hole portion 131 configured to accommodate the actuator unit composed of the piezoelectric members 121 and the base substrate 122, a recess portion serving as the common liquid chamber 108, and an ink supply hole 132 serving as a liquid supply port configured to supply ink from outside to the common liquid chamber 108.

The flow channel plate 101 has the nozzle communication path 105, and a recess portion and a hole serving as the pressurizing liquid chamber 106, which are formed by anisotropically etching a single crystal silicon substrate having a crystal plane orientation (110) with an alkaline etchant such as a potassium hydroxide (KOH) aqueous solution. However, the flow channel plate is not limited to those formed of the single crystal silicon substrate. Other materials such as a stainless steel substrate or photosensitive resin may be used.

The oscillation plate 102 is made of a metallic nickel plate and is fabricated, for example, by electroforming (electromolding). However, other metallic plates or a connected member of metal and resin plates may be used. The piezoelectric element columns 121A and 121B of the piezoelectric members 121 are adhesively bonded to the oscillation plate 102, which are further adhesively bonded to the frame member 130.

The nozzle plate 103 includes the nozzles 104 having a diameter of 10 μm to 30 μm corresponding to the respective pressurizing liquid chambers 106, and is adhesively bonded to the flow channel plate 101. The nozzle plate 103 is obtained by forming a water-repellent layer on an outermost surface of a nozzle forming member made of a metal member via required layers.

The piezoelectric member 121 is the stacked piezoelectric element (herein referred to as PZT) obtained by alternately stacking piezoelectric materials 151 and internal electrodes 152. An individual electrode 153 and a common electrode 154 are connected to each of the internal electrodes 152 alternately pulled out to different end faces of the piezoelectric member 121. Notably, in this embodiment, the liquid ejection head is configured such that the ink in the pressurizing liquid chamber 106 is pressurized using a displacement in a d33 direction as a piezoelectric direction of the piezoelectric member 121. However, the liquid ejection head may be configured such that the ink in the pressurizing liquid chamber 106 is pressurized using a displacement in a d31 direction as a piezoelectric direction of the piezoelectric member 121.

In the liquid ejection head having the above configuration, the voltage applied to the piezoelectric member 121 is lowered from a reference potential Ve to cause the driving piezoelectric member column 121A to contract, which lowers the oscillation plate 102 and expands the volume of the pressurizing liquid chamber 106. As a result, ink flows into the pressurizing liquid chamber 106. Thereafter, the voltage applied to the piezoelectric element column 121A is raised to cause the piezoelectric element column 121A to extend in a stacked direction, which deforms the oscillation plate 102 toward the nozzle 104 direction and contract the volume of the pressurizing liquid chamber 106. As a result, the ink in the pressurizing liquid chamber 106 is pressurized to thereby eject (jet) ink droplets from the nozzles 104.

When the voltage applied to the driving piezoelectric member column 121A returns to the reference potential Ve, the oscillation plate 102 returns to an initial position, which expands the pressurizing liquid chamber 106 to thereby generate a negative pressure. As a result, the ink is supplied into the pressurizing liquid chamber 106 from the common liquid chamber 108. After the oscillations of meniscus faces in the nozzles 104 are damped and stabilized, the liquid ejection head is shifted for a next droplet ejection operation.

A method for driving the head is not limited to the above-mentioned method (pull and push-out method). Depending on a waveform to be input, a pull-out method or a push-out method may be utilized.

In an inkjet recording, it has been known that ejection property of ink droplets is greatly affected by the shape and formation precision of a nozzle, and surface properties of a nozzle plate. The ink is deposited in proximity to the nozzle on the surface of the nozzle plate causes failures such as a deflected ejection direction of the ink droplets and instability of jetting speed. In order to prevent the failures resulted from the deposited ink, it has been attempted to stably eject the ink droplets by making the surface of the nozzle plate (surface onto which the ink is ejected) to be water-repellent through formation of a water-repellent film.

However, the water-repellent film is gradually peeled off by wiping off the ink deposited on the water-repellent film through the maintenance work (e.g., suction), leading to deterioration of the water-repellency of the nozzle plate. In order to address the above failure, although it has been attempted to improve adhesiveness between the water-repellent film and the nozzle plate, it is not easy to prevent the water-repellent film from deteriorating.

The recording head used in the present invention includes a nozzle plate on which a nozzle is formed, and a water-repellent film which is provided on a surface of the nozzle plate onto which an ink is ejected. As a primer layer of the water-repellent film, a primer layer formed of an inorganic oxide may be provided between the nozzle plate and the water-repellent film.

The water-repellent film preferably contains a polymer containing a perfluoroalkyl chain. A method for forming the water-repellent film is preferably any of the following methods:

(1) Sol-gel method: A solution of a water-repellent treatment agent in which (A) a polymer and/or an oligomer containing at least one perfluoroalkyl group and at least one alkoxysilyl group and (B) a silane compound represented by the following General Formula (II) are dissolved into a solvent is applied onto a substrate, followed by allowing to react to form a water-repellent film and to adhere onto the substrate.

$$Si(Y)(OR)_3 \qquad \text{General Formula (II)}$$

In the General Formula (II), R denotes a hydrogen atom or an alkyl group; Y denotes a substituted or unsubstituted alkyl group, a substituted or unsubstituted aryl group, or OR group in the General Formula (II) which has the same meaning as described above; and each R may be the same as or different from each other.

(2) Vapor deposition method: On a $SiO_2$ film formed on a surface onto which droplets for recording are ejected, vapor deposition using, as a vapor deposition source, (A) a polymer and/or an oligomer containing at least one perfluoroalkyl group and at least one alkoxysilyl group and vapor deposition using, as a vapor deposition source, (B) a silane compound represented by the General Formula (II) are separately repeated in difference zones of a vacuum chamber. The resultant vapor deposited (A) and (B) are allowed to react to form a water-repellent film and to adhere onto the $SiO_2$ film.

Figure 17:
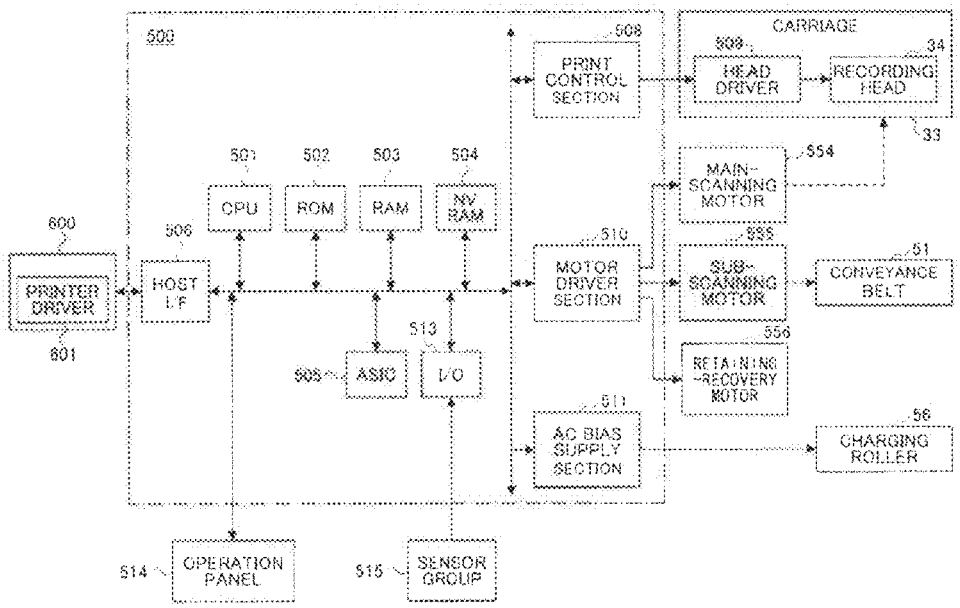
FIG. 17 is a schematic block diagram illustrating one exemplary control section of an inkjet recording device of the present invention.

Next, an outline of a control section of an inkjet recording device is described with reference to FIG. 17. Notably, this figure is a block diagram illustrating the control section.

The control section 500 includes a CPU 501 configured to control the entire inkjet recording device and a spitting operation according to the present invention; a ROM 502 configured to store computer programs to be executed by the CPU 501 and other fixed data; a RAM 503 configured to temporarily store data such as image data; a rewritable non-volatile memory 504 configured to store data regardless of the power supply of the inkjet recording device being turned on or off, and an ASIC 505 configured to process various signals for processing image data, and input and output signals for image processing such as sorting and for controlling the entire inkjet recording device.

The control section 500 further includes a print control section 508 including a data transfer unit and a signal generating unit configured to drive-control the recording head 34; a head driver (driver IC) 509 configured to drive the recording head 34 provided at the carriage 33 side; a motor control section 510 configured to drive a main-scanning motor 554 for moving the carriage 33 to scan, a sub-scanning motor 555 for rotationally moving the conveyance belt 51, a retaining-recovery motor 556 for moving the caps 82 of the retaining-recovery mechanism 81 and the wiper member 83; and an AC bias supply section 511 configured to supply an AC bias to the charging roller 56.

The controller 500 is connected to an operation panel 514 for inputting and displaying desired information in the inkjet recording device.

The control section 500 further includes an I/F 506 configured to communicate with a host side for receiving and sending data and signals, such that the I/F 506 receives the data and signals via a cable or the network from the host side 600 including an information processing apparatus such as a personal computer, an image reading apparatus such as an image scanner, and an imaging apparatus such as a digital camera.

The CPU 501 of the control section 500 retrieves printing data from a receive buffer in the I/F 506 to analyze the retrieved printing data, causes the ASIC 505 to perform desired processing such as image processing or sorting data, and transfers the processed data from the print control section 508 to the head driver 509. Note that dot pattern data for outputting images are generated by a printer driver 601 located at the host side 600.

The print control section 508 serially transfers the above image data while outputting transfer clocks, latch signals, and control signals required for transferring the above image data to the head driver 509. Additionally, the print control section further includes a driving signal generating section composed of a D/A converter configured to D/A convert pattern data of drive pulses stored in the ROM 502, a voltage amplifier, and a current amplifier, which are used for outputting a certain signal used in the present invention to the head driver 509.

The head driver 509 generates pull pulses and ejecting pulses by selecting the drive pulses forming a drive waveform supplied from the print control section 508 based on the image data corresponding to one line of the image data serially input to the recording head 34. The head driver then applies the generated pulses to the piezoelectric members 121 serving as a pressure generating unit configured to generate energy for ejecting liquid droplets from the recording head 7, to thereby drive the recording head 34. In this process, different sizes of dots such as large, medium, and small sized droplets may be formed by selecting a part of or an entire part of the drive pulses constituting the driving signal and a part of or an entire part of the waveform components constituting the drive pluses.

An I/O section 513 acquires information from a sensor group 515 having various sensors attached to the inkjet recording device, selects desired information for controlling the printer, and use the acquired information for controlling the print control section 508, the motor control section 510, and the AC bias supply section 511. The sensor group 515 includes optical sensors configured to detect a position of a sheet of paper; a thermistor configured to monitor the temperature within the device; sensors configured to monitor the voltage of the charging belt; and an interlock switch configured to detect open or close state of a cover. The I/O section 513 can process various kinds of sensor information.

Figure 18:
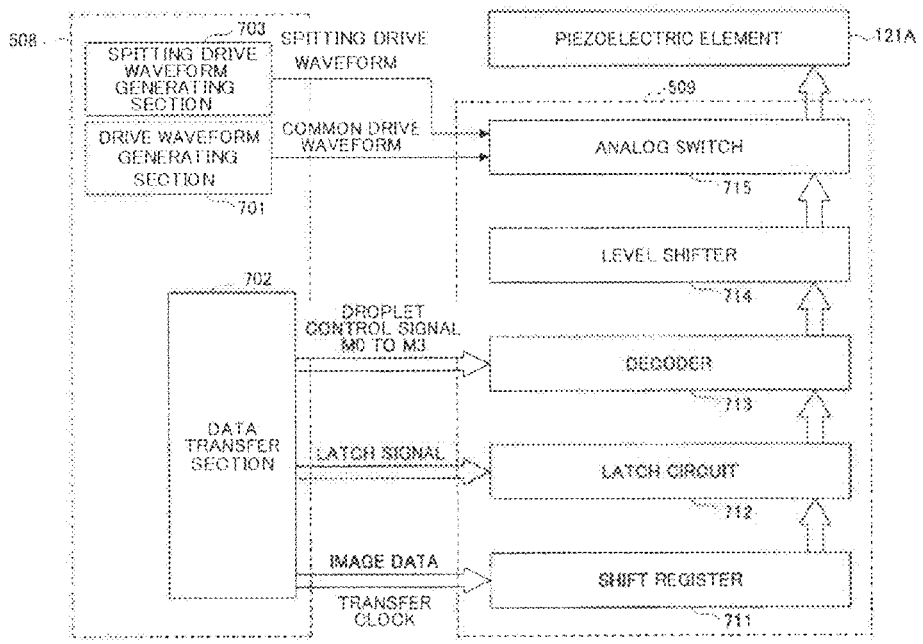
FIG. 18 is a block diagram illustrating one exemplary printing control section and head driver of an inkjet recording device of the present invention.

Next, examples of the print control section 508 and the head driver 509 are described with reference to FIG. 18.

The print control section 508 includes a drive waveform generating section 701 configured to generate and output a signal including pull pulses within one printing cycle upon image formation; a data transfer section 702 configured to output 2-bit image data (grayscale signal 0, 1) corresponding to a printed image, clock signals, latch signals (LAT), droplet control signals M0 to M3; and a spitting drive waveform generating section 703 configured to generate and output a drive waveform for spitting.

Note that the droplet control signal is a 2-bit signal for instructing switching of the analog switch 715 serving as a switching unit of the head driver 509 for each droplet. The droplet control signal switches to a high (H) level (ON) for selecting the drive pulses or the waveform components, and switches to a low (L) level (OFF) for not selecting the drive pulses or the waveform components, based on the printing cycle of the common drive waveform.

The head driver 509 includes a shift register 711 configured to input transfer clocks (shift clocks) transferred from a data transfer section 702 and serial image data (grayscale data: 2 bits/1 channel (1 nozzle)); a latch circuit 712 configured to latch various registration values from the shift register 711 with latch signals; a decoder 713 configured to decode the grayscale data and the control signals M0 to M3 and output the decoded results; a level shifter 714 configured to perform level conversion on a logic-level voltage signal of the decoder 713 to an analog-level voltage signal which is operable by an analog switch 715; and an analog switch 716 configured to be switched on or off (open or close) by the signal outputted from the decoder 713 via the level shifter 714.

(Ink Recorded Matter)

An ink recorded matter of the present invention includes a recording medium and an image on the recording medium, wherein the image is formed by the inkjet recording method of the present invention.

The recording medium is not particularly limited and may be appropriately selected depending on the intended purpose. Examples thereof include plain paper, glossy paper, coat paper, special paper, fabric, film, an OHP sheet, and general purpose printing paper. These may be used alone or in combination.

The ink recorded matter may be suitably used for various applications as, for example, a document on which various characters or images are recorded.

EXAMPLES

Examples of the present invention now will be described, but the present invention is not limited thereto. In the following description, "part(s)" means "part(s) by mass," unless otherwise stated, and "%" means "% by mass," unless otherwise stated.

Pigment Dispersion Production Example 1

—Preparation of Cyan Dispersion—

A 1 L-flask equipped with a mechanical stirrer, a thermometer, a nitrogen-inlet tube, a reflux tube and a dropping funnel, which had been sufficiently purged with nitrogen gas, was charged with styrene (11.2 g), acrylic acid (2.8 g), lauryl methacrylate (12.0 g), polyethylene glycol methacrylate (4.0 g), styrene macromer (4.0 g) (manufactured by TOAGOSEI CO., LTD., product name: AS-6), and mercaptoethanol (0.4 g), followed by heating to 65° C. Next, a mixed solution of styrene (100.8 g), acrylic acid (25.2 g), lauryl methacrylate (108.0 g), polyethylene glycol methacrylate (36.0 g), hydroxylethyl methacrylate (60.0 g), styrene macromer (36.0 g) (manufactured by TOAGOSEI CO., LTD., product name: AS-6), mercaptoethanol (3.6 g), azobis methylvaleronitrile (2.4 g), and methyl ethyl ketone (18 g) was added dropwise into the flask for 2.5 hours.

Thereafter, a mixed solution of azobis methylvaleronitrile (0.8 g) and methyl ethyl ketone (18 g) was added dropwise into the flask for 0.5 hours. After aging the mixture at 65° C. for 1 hour, azobis methylvaleronitrile (0.8 g) was added thereto, and the resulting mixture was further aged for 1 hour. Upon completion of the reaction, methyl ethyl ketone (364 g) was added to the flask, to thereby obtain a polymer solution (800 g) having a concentration of 50% by mass.

Next, the resultant polymer solution is partially dried and measured for the weight average molecular weight by a gel permeation chromatography (standard: polystyrene, solvent: tetrahydrofuran). As a result, the polymer solution was found to have the weight average molecular weight of 15,000.

The polymer solution (28 g), Pigment Blue 15:3 (manufactured by Dainichiseika Color & Chemicals Mfg. Co., Ltd., CHROMOFINEBLUE A-220JC) (26 g), a 1 mol/L aqueous solution of potassium hydroxide (13.6 g), methylethyl ketone (20 g), and ion-exchanged water (30 g) were sufficiently stirred.

Then, the resultant was kneaded 20 times with a three roll mill (manufactured by Noritake Co., Limited, product name: NR-84A). The resultant paste was loaded into ion-exchanged water (200 g), followed by sufficiently stirring and distilling off methyl ethyl ketone and water by an evaporator, to thereby obtain a blue polymer particle dispersion (160 g) having a solid content of 20.0% by mass.

The obtained polymer particles were found to have the average particle diameter (D50%) of 98 nm as measured by MICROTRAC UPA (manufactured by NIKKISO CO., LTD.).

Pigment Dispersion Production Example 2

—Preparation of Magenta Dispersion—

A magenta polymer particle dispersion was obtained in the same manner as in Pigment dispersion Production Example 1, except that the Pigment Blue 15:3 was changed to Pigment Red 122 (CHROMOFINE MAGENTA 6886; manufactured by Dainichiseika Color & Chemicals Mfg. Co., Ltd.).

The obtained polymer particles were found to have the average particle diameter (D50%) of 124 nm as measured by MICROTRAC UPA (manufactured by NIKKISO CO., LTD.).

Pigment Dispersion Production Example 3

—Preparation of Yellow Dispersion—

A yellow polymer particle dispersion was obtained in the same manner as in Pigment dispersion Production Example 1, except that the Pigment Blue 15:3 was changed to Pigment Yellow 74 (FASTYELLOW 531; manufactured by Dainichiseika Color & Chemicals Mfg. Co., Ltd.).

The obtained polymer particles were found to have the average particle diameter (D50%) of 78 nm as measured by MICROTRAC UPA (manufactured by NIKKISO CO., LTD.).

Pigment Dispersion Production Example 4

—Preparation of Black Dispersion—

A black polymer particle dispersion was obtained in the same manner as in Pigment dispersion Production Example 1, except that the Pigment Blue 15:3 was changed to carbon black (FW100; manufactured by Evonik Industries AG).

The obtained polymer particles were found to have the average particle diameter (D50%) of 110 nm as measured by MICROTRAC UPA (manufactured by NIKKISO CO., LTD.).

Ink Preparation Examples 1 to 20

Ink Preparation Examples 1 to 20 were produced by a routine procedure according to formulations described in Tables 1 to 4 using pigment dispersions produced in Pigment dispersion Production Examples 1 to 4, and adjusted to pH 9 with a 10% aqueous sodium hydroxide solution.

Specifically, a water-soluble organic solvent, a surfactant, an antifungal agent, a foam inhibitor, a defoaming agent, a penetrating agent, and ion-exchanged water were mixed in this order, following by stirring for 30 min. Then, each of the pigment dispersions produced in Pigment dispersion Production Examples 1 to 4 was added thereto, followed by stirring for 30 min and filtering through a membrane filter (pore diameter: 0.8 μm) to thereby obtain each of Ink Preparation Examples 1 to 20. Notably, the unit of numerical values described in Tables 1 to 4 is "% by mass."

TABLE 1

| | | Ink Preparation Example | | | | | |
|---|---|---|---|---|---|---|---|
| | | 1 | 2 | 3 | 4 | 5 | 6 |
| Dispersion Production Example 1 | C | 40.0 | | | | 30.0 | |
| Dispersion Production Example 2 | M | | 50.0 | | | | 45.0 |
| Dispersion Production Example 3 | Y | | | 38.0 | | | |

TABLE 1-continued

| | | Ink Preparation Example | | | | | |
|---|---|---|---|---|---|---|---|
| | | 1 | 2 | 3 | 4 | 5 | 6 |
| Dispersion Production Example 4 | K | | | | 50.0 | | |
| Surfactant | Surfactant A | 0.03 | 0.03 | 0.03 | 0.03 | 0.05 | 0.05 |
| | Surfactant B | | | | | | |
| | Surfactant C | | | | | | |
| | Surfactant D | | | | | | |
| Water-Soluble Organic Solvent | Glycerin | | | | | 7.0 | 7.0 |
| | 3-methyl-1,3-butanediol | | | | | 2.0 | |
| | 1,3-butanediol | 8.0 | | | | | 10.0 |
| | 1,2-butanediol | | | 7.0 | 12.0 | | |
| | 1,2-propanediol | 32.0 | 35.0 | 30.0 | 21.0 | | |
| | 1,6-hexanediol | | | | | 30.0 | |
| | 1,5-pentanediol | | | | | | 20.0 |
| | 2-pyrrolidone | | | | | | |
| Foam Inhibitor | 2,4,7,9-tetramethyldecane-4,7-diol | 0.20 | 0.20 | 0.20 | 0.20 | 0.30 | 0.25 |
| Defoaming Agent | KM-72F | | | | | | |
| Penetrating Agent | 2-ethyl-1,3-hexanediol | 3.0 | 3.0 | 2.0 | 2.0 | 2.0 | 2.0 |
| Antifungal Agent | PROXEL LV | 0.25 | 0.25 | 0.25 | 0.25 | 0.25 | 0.25 |
| pH adjusting agent | 10% aqueous sodium hydroxide solution | q.s. | q.s. | q.s. | q.s. | q.s. | q.s. |
| | Pure Water | Balance | Balance | Balance | Balance | Balance | Balance |
| | Total (% by mass) | 100.0 | 100.0 | 100.0 | 100.0 | 100.0 | 100.0 |

TABLE 2

| | | Ink Preparation Example | | | | | |
|---|---|---|---|---|---|---|---|
| | | 7 | 8 | 9 | 10 | 11 | 12 |
| Dispersion Production Example 1 | C | | | 15.0 | | | |
| Dispersion Production Example 2 | M | | | | 20.0 | | |
| Dispersion Production Example 3 | Y | 13.0 | | | | 20.0 | |
| Dispersion Production Example 4 | K | | 20.0 | | | | 30.0 |
| Surfactant | Surfactant A | | | | | | |
| | Surfactant B | 2.0 | 2.0 | | | 5.0 | 5.0 |
| | Surfactant C | | | 0.40 | 0.40 | | |
| | Surfactant D | | | | | | |
| Water-Soluble Organic Solvent | Glycerin | 26.0 | 20.0 | 5.0 | 5.0 | 28.0 | 16.0 |
| | 3-methyl-1,3-butanediol | | 20.0 | | | | |
| | 1,3-butanediol | | | | | 14.0 | |
| | 1,2-butanediol | 15.0 | | | | | 23.0 |
| | 1,2-propanediol | | | | | | |
| | 1,6-hexanediol | | | | | | |
| | 1,5-pentanediol | | | 25.0 | 25.0 | | |
| | 2-pyrrolidone | | | 2.0 | 2.0 | | |
| Foam Inhibitor | 2,4,7,9-tetramethyldecane-4,7-diol | | | 0.20 | 0.20 | | |
| Defoaming Agent | KM-72F | 0.50 | 0.50 | | | 1.5 | 1.5 |
| Penetrating Agent | 2-ethyl-1,3-hexanediol | 2.5 | 2.5 | 2.5 | 2.5 | 2.0 | 2.0 |
| Antifungal Agent | PROXEL LV | 0.20 | 0.20 | 0.20 | 0.20 | 0.20 | 0.20 |
| pH adjusting agent | 10% aqueous sodium hydroxide solution | q.s. | q.s. | q.s. | q.s. | q.s. | q.s. |
| | Pure Water | Balance | Balance | Balance | Balance | Balance | Balance |
| | Total (% by mass) | 100.0 | 100.0 | 100.0 | 100.0 | 100.0 | 100.0 |

TABLE 3

| | | Ink Preparation Example | | | | | |
|---|---|---|---|---|---|---|---|
| | | 13 | 14 | 15 | 16 | 17 | 18 |
| Dispersion Production Example 1 | C | 20.0 | | | | 15.0 | |
| Dispersion Production Example 2 | M | | 25.0 | | | | 20.0 |
| Dispersion Production Example 3 | Y | | | 20.0 | | | |
| Dispersion Production Example 4 | K | | | | 25.0 | | |
| Surfactant | Surfactant A | | | 0.02 | 0.02 | 0.05 | 0.05 |
| | Surfactant B | | | | | | |
| | Surfactant C | | | | | | |
| | Surfactant D | 2.2 | 2.2 | | | | |
| Water-Soluble Organic Solvent | Glycerin | 15.0 | 15.0 | 10.0 | 10.0 | 6.0 | 6.0 |
| | 3-methyl-1,3-butanediol | | | | 20.0 | | |
| | 1,3-butanediol | | | | | | |
| | 1,2-butanediol | | | 23.0 | | | |
| | 1,2-propanediol | | 20.0 | | | | |
| | 1,6-hexanediol | 18.0 | | | | 30.0 | 28.0 |
| | 1,5-pentanediol | | | | | | |
| | 2-pyrrolidone | | | | | 2.0 | 2.0 |
| Foam Inhibitor | 2,4,7,9-tetramethyldecane-4,7-diol | | | 0.15 | 0.15 | 0.45 | 0.45 |
| Defoaming Agent | KM-72F | 0.50 | 0.50 | | | | |
| Penetrating Agent | 2-ethyl-1,3-hexanediol | 2.0 | 2.0 | 3.0 | 3.0 | 2.0 | 2.0 |
| Antifungal Agent | PROXEL LV | 0.25 | 0.25 | 0.25 | 0.25 | 0.25 | 0.25 |
| pH adjusting agent | 10% aqueous sodium hydroxide solution | q.s. | q.s. | q.s. | q.s. | q.s. | q.s. |
| | Pure Water | Balance | Balance | Balance | Balance | Balance | Balance |
| | Total (% by mass) | 100.0 | 100.0 | 100.0 | 100.0 | 100.0 | 100.0 |

TABLE 4

| | | Ink Preparation Example | |
|---|---|---|---|
| | | 19 | 20 |
| Dispersion Production Example 1 | C | | |
| Dispersion Production Example 2 | M | | |
| Dispersion Production Example 3 | Y | 25.0 | |
| Dispersion Production Example 4 | K | | 30.0 |
| Surfactant | Surfactant A | | |
| | Surfactant B | | |
| | Surfactant C | | |
| | Surfactant D | 1.0 | 1.0 |
| Water-Soluble Organic Solvent | Glycerin | 8.5 | 8.5 |
| | 3-methyl-1,3-butanediol | | |
| | 1,3-butanediol | | |
| | 1,2-butanediol | 20.0 | |
| | 1,2-propanediol | | 22.0 |
| | 1,6-hexanediol | | |
| | 1,5-pentanediol | | |
| | 2-pyrrolidone | | |
| Foam Inhibitor | 2,4,7,9-tetramethyldecane-4,7-diol | | |
| Defoaming Agent | KM-72F | 0.20 | 0.20 |

TABLE 4-continued

| | | Ink Preparation Example | |
|---|---|---|---|
| | | 19 | 20 |
| Penetrating Agent | 2-ethyl-1,3-hexanediol | 2.0 | 2.0 |
| Antifungal Agent | PROXEL LV | 0.25 | 0.25 |
| pH adjusting agent | 10% aqueous sodium hydroxide solution | q. s. | q.s. |
| | Pure Water | Balance | Balance |
| | Total (% by mass) | 100.0 | 100.0 |

Abbreviations described in Tables 1 to 4 and 8 to 12 have meanings as follows.

Surfactant A: UNYDINE DSN-403N (manufactured by DAIKIN INDUSTRIES, LTD, the average addition number of moles of (poly)alkylene glycol units: 8)

Surfactant B: a compound represented by the following General Formula (III) (FS-300, manufactured by E. I. du Pont de Nemours and Company)

$$C_8F_{17}—CH_2CH_2O—(CH_2CH_2O)_n—H \qquad \text{General Formula (III)}$$

(wherein is 1 to 40)

Surfactant C: polyether-modified silicone surfactant (BYK-349, manufactured by BYK-Chemie GmbH, component: 100% by mass)

Surfactant D: sodium polyoxyethylene (3) tridecyl ether acetate (ECTD-3NEX, manufactured by Nikko Chemicals Co., Ltd.)

KM-72F: self-emulsifying silicone defoaming agent (manufactured by Shin-Etsu Chemical Co., Ltd., component: 100% by mass)

PROXEL LV: antifungal agent (manufactured by Nitto Denko Avecia Inc.)

Onto a surface of the nozzle plate, at 25° C., 3 μL of each ink to be evaluated was ejected from a syringe equipped with a syringe needle (internal diameter: 0.37 μm). The ink was measured for the receding contact angle (°) at 25° C. with an automatic contact angle meter (OCA200H, manufactured by Data Physics Corporation) using a contraction method.

Notably, a nozzle plate which has been subjected to a water-repellent treatment in the same manner as above described is equipped to a head of an inkjet printer used for the below-described printing evaluation.

TABLE 5

| | | Static Surface Tension | | Receding Contact Angle | |
|---|---|---|---|---|---|
| | Viscosity (mPa · s) | Measurement Value of Static Surface Tension (mN/m) | Evaluation | Measurement Value of Receding Contact Angle (°) | Evaluation |
| Ink Prep. Ex. 1 | 8.33 | 21.1 | A | 42 | A |
| Ink Prep. Ex. 2 | 8.10 | 21.8 | A | 40 | A |
| Ink Prep. Ex. 3 | 8.21 | 20.5 | A | 38 | A |
| Ink Prep. Ex. 4 | 7.92 | 22.2 | A | 45 | A |
| Ink Prep. Ex. 5 | 8.15 | 18.9 | A | 42 | A |
| Ink Prep. Ex. 6 | 8.06 | 19.5 | A | 39 | A |
| Ink Prep. Ex. 7 | 7.99 | 23.8 | A | 46 | A |
| Ink Prep. Ex. 8 | 8.03 | 24.2 | A | 45 | A |
| Ink Prep. Ex. 9 | 7.88 | 21.9 | A | 44 | A |
| Ink Prep. Ex. 10 | 7.94 | 22.1 | A | 45 | A |
| Ink Prep. Ex. 11 | 8.10 | 19.0 | A | 30 | A |
| Ink Prep. Ex. 12 | 8.04 | 18.8 | A | 32 | A |
| Ink Prep. Ex. 13 | 7.44 | 27.7 | B | 48 | A |
| Ink Prep. Ex. 14 | 7.60 | 28.4 | B | 49 | A |
| Ink Prep. Ex. 15 | 7.81 | 22.7 | A | 64 | B |
| Ink Prep. Ex. 16 | 7.77 | 24.0 | A | 66 | B |
| Ink Prep. Ex. 17 | 8.13 | 20.3 | A | 68 | B |
| Ink Prep. Ex. 18 | 8.07 | 21.1 | A | 63 | B |
| Ink Prep. Ex. 19 | 6.72 | 38.2 | B | 54 | B |
| Ink Prep. Ex. 20 | 6.93 | 37.6 | B | 53 | B |

<Physical Properties of Ink>

Each of the inks of the above Ink Preparation Examples 1 to 20 was measured in the following manner for viscosity, static surface tension, and receding contact angle. Results are shown in Table 5.

As for the static surface tension, 18.0 mN/m to 27.0 mN/m is determined as "A" and less than 18.0 mN/m or more than 27.0 mN/m is determined as "B." Similarly, as for the receding contact angle, less than 50° is determined as "A" and 50° or more is determined as "B." Results are also shown in Table 5.

—Viscosity—

Each ink was measured for the viscosity (mPa·s) at 25° C. with R-type viscometer (RC-500, manufactured by Told Sangyo Co., Ltd) at an appropriate rotation speed of 10 rpm to 100 rpm.

—Static Surface Tension—

Each ink was measured for the static surface tension (mN/m) at 25° C. with an automatic tensiometer (CBVP-Z, manufactured by Kyowa Interface Science Co., Ltd) using a platinum plate method.

—Receding Contact Angle—

Perfluoroether (weight average molecular weight: 1,000 to 8,000) was vapor deposited onto a substrate for a nozzle plate formed of SUS316 (thickness: 50 μm) to thereby produce a nozzle plate with a water-repellent film (thickness: 1 nm±0.5 nm).

Examples 1 to 12 and Comparative Examples 1 to 28

Each ink was evaluated as follows.

<Preparation of Printer Prior to Evaluation>

Under an environment adjusted to 25° C.±0.5° C. and 50%±5% RH, an inkjet printer (IPSIO GXE3300, manufactured by Ricoh Company Limited) was used to select a waveform which allowed for the most stable ejection of each of inks having varying viscosities. The selected waveforms were used in all printing evaluations.

The inkjet printer includes a liquid ejection head providing with a pressure chamber in communication with a nozzle opening configured to eject ink droplets and a pressure generating element configured to cause pressure fluctuation in the pressure chamber; and a driving signal generating unit configured to select a drive pulse from a drive waveform including one or more time-series drive pulses and to generate an ejection pulse in accordance with the size of ink droplets. Also, the inkjet printer can form an image on a recording medium by applying the ejection pulse to the pressure generating element to thereby eject ink droplets from the nozzle opening.

In the case where an image is formed on a recording medium by ejecting the ink droplets from the nozzle opening according to an inkjet recording method of the present invention, a drive pulse which is located at the head of the one or more ejecting pulses within one printing unit cycle and which is configured to contract the pressure chamber to thereby eject ink droplets is set to have a waveform element for expanding the pressure chamber to pull the meniscus into the nozzle in the two-step manner (two-step pulling) immediately in front of the drive pulse.

Figure 19:
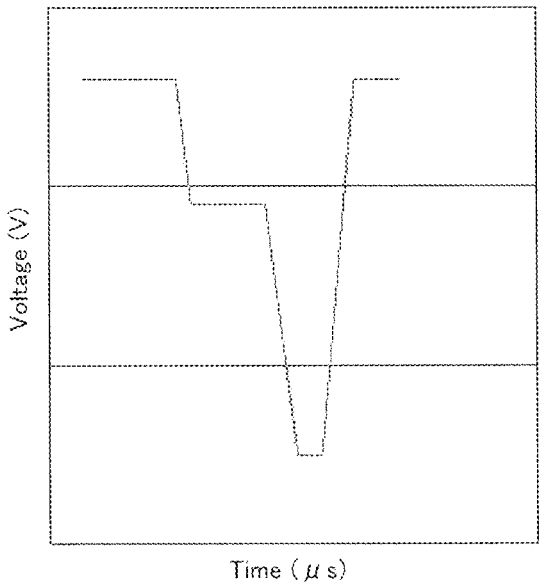
FIG. 19 is a graph illustrating an ejection waveform including a driving signal for pulling a meniscus into a nozzle in a two-step manner.
Figure 20:
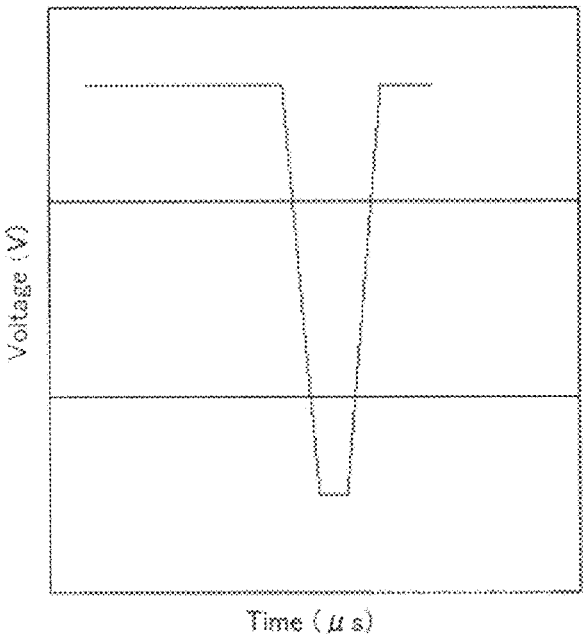
FIG. 20 is a graph illustrating an ejection waveform including a driving signal for pulling a meniscus into a nozzle in a one-step manner.

In this case, an ejection waveform including a driving signal for pulling the meniscus in the two-step manner immediately prior to ejection, as illustrated in FIG. 19, is referred to as "Waveform 1," and an ejection waveform including a driving signal for pulling the meniscus in the one-step manner immediately prior to ejection, as illustrated in FIG. 20, is referred to as "Waveform 2." In the case of applying Waveform 1, ejection results of Ink Preparation Examples 1 to 12 were determined as Examples 1 to 12, and ejection results of Ink Preparation Examples 13 to 20 were determined as Comparative Examples 1 to 8. Similarly, in the case of applying Waveform 2, ejection results of Ink Preparation Examples 1 to 10 were determined as Comparative Examples 9 to 20, and ejection results of Ink Preparation Examples 13 to 20 were determined as Comparative Examples 21 to 28. Prior to evaluation, the ink was deposited onto a surface of the nozzle plate and wiped off with a wiper blade. This procedure was repeated 2,000 times. Thus, the water-repellent film on the surface of the nozzle plate was intentionally deteriorated.

<Ejection Stability>

Printing was performed on MY PAPER (manufactured by Ricoh Japan Corporation) by means of the inkjet printer (IPSIO GXE3300, manufactured by Ricoh Company Limited). As for a printing pattern, a chart in which printing area of each color was 5% relative to a total area of the sheet was used, and each ink of yellow, magenta, cyan, and black was printed at 100%-duty. As for the printing conditions, the recording density was 600 dpi, and the printing was carried out with one-pass printing. Printing samples were produced for two waveforms, i.e., Waveform 1 and Waveform 2. In this evaluation, intermittent printing was performed in the following manner. After continuously printing the chart on 20 sheets, the printer was turned into a resting state for 20 min during which ejection was not performed. This process was repeated 50 times until 1,000 sheets were printed in total. Then, the same chart was printed again, and the resultant was visually observed whether there was any streak, white void, and jetting disturbance in the 5% chart solid area. The evaluation criteria are as follows, where "A" is considered to be a pass and "B" and "C" are considered to be a failure.

[Evaluation Criteria]

A: There were two or less portions where streak, white void, and jetting disturbance were observable in the solid area.

B: There were three or more portions where streak, white void, and jetting disturbance were observable in the solid area.

C: Streaks, white voids, and jetting disturbance were observed throughout the solid area.

<<Uniformity in Solid Printing Area (Uniformity of Solid Portion)>>

Printing was performed on RICOH BUSINESS COAT GLOSS 100 (manufactured by Ricoh Company Limited) by means of the inkjet printer (IPSIO GXE3300, manufactured by Ricoh Company Limited). As for a printing pattern, each ink of yellow, magenta, cyan, and black was printed at 100%-duty. Printing samples were produced for two waveforms, i.e., Waveform 1 and Waveform 2.

The samples were visually observed and evaluated for uniformity of the solid portion thereof. The evaluation criteria are as follows, where "A" is considered to be a pass and "B" and "C" are considered to be a failure.

[Evaluation Criteria]

A: Almost no spot is visible in the solid area.

B: Some spots are visible in the solid area.

C: Spots are visible throughout the solid area.

<Permeability into Recording Media>

This evaluation was performed for only "Waveform 1."

Printing was performed on [Paper 1] and [Paper 2] by means of the inkjet printer (IPSIO GXE3300, manufactured by Ricoh Company Limited). Notably, [Paper 1] and [Paper 2] were as follows:

[Paper 1] Plain paper: OKH-J OFF (manufactured by Oji Paper Co., Ltd.)

[Paper 2] Coat paper: LUMI ART GROSS (manufactured by Stora Enso)

As for a printing pattern, a chart in which printing area of each color was 5% relative to a total area of the sheet was used, and each ink of yellow, magenta, cyan, and black was printed at 100%-duty. As for the printing conditions, the recording density was 600 dpi, and the printing was carried out with one-pass printing. Thus, a printing sample was produced for "Waveform 1."

Thirty seconds after printing, MY PAPER (manufactured by Ricoh Japan Corporation) was placed on a printed surface, followed by rubbing back and forth on the same line 20 times with a 1 kg load applied. After the completion of rubbing, an ink stain on MY PAPER was evaluated according to the following criteria, where "A" and "AA" were considered to be a pass.

[Evaluation Criteria]

AA: No ink stain is visible.

A: Almost no ink stain is visible.

B: Several dense ink stains are visible.

C: Ink stains are visible all over.

Evaluation results are shown in Tables 6 and 7. As for the receding contact angle, less than 50° was determined as "A" and 50° or more was determined as "B." As for the static surface tension, 18.0 mN/m to 27.0 mN/m was determined as "A" and less than 18.0 mN/m or more than 27.0 mN/m was determined as "B."

TABLE 6

| | Evaluation of receding contact angle | Evaluation of static surface tension | | Waveform | Ejection stability | Uniformity in solid area | Permeability into recording media | |
|---|---|---|---|---|---|---|---|---|
| | | | | | | | Paper 1 | Paper 2 |
| Ink Prep. Ex. 1 | A | A | Ex. 1 | 1 | A | A | AA | A |

TABLE 6-continued

| | Evaluation of receding contact angle | Evaluation of static surface tension | | Waveform | Ejection stability | Uniformity in solid area | Permeability into recording media | |
|---|---|---|---|---|---|---|---|---|
| | | | | | | | Paper 1 | Paper 2 |
| Ink Prep. Ex. 2 | A | A | Ex. 2 | 1 | A | A | AA | A |
| Ink Prep. Ex. 3 | A | A | Ex. 3 | 1 | A | A | AA | A |
| Ink Prep. Ex. 4 | A | A | Ex. 4 | 1 | A | A | AA | A |
| Ink Prep. Ex. 5 | A | A | Ex. 5 | 1 | A | A | AA | A |
| Ink Prep. Ex. 6 | A | A | Ex. 6 | 1 | A | A | AA | A |
| Ink Prep. Ex. 7 | A | A | Ex. 7 | 1 | A | A | AA | A |
| Ink Prep. Ex. 8 | A | A | Ex. 8 | 1 | A | A | AA | A |
| Ink Prep. Ex. 9 | A | A | Ex. 9 | 1 | A | A | AA | A |
| Ink Prep. Ex. 10 | A | A | Ex. 10 | 1 | A | A | AA | A |
| Ink Prep. Ex. 11 | A | A | Ex. 11 | 1 | A | A | AA | A |
| Ink Prep. Ex. 12 | A | A | Ex. 12 | 1 | A | A | AA | A |
| Ink Prep. Ex. 13 | A | B | Comp. Ex. 1 | 1 | B | B | AA | A |
| Ink Prep. Ex. 14 | A | B | Comp. Ex. 2 | 1 | B | B | AA | A |
| Ink Prep. Ex. 15 | B | A | Comp. Ex. 3 | 1 | A | A | A | C |
| Ink Prep. Ex. 16 | B | A | Comp. Ex. 4 | 1 | A | A | A | C |
| Ink Prep. Ex. 17 | B | A | Comp. Ex. 5 | 1 | A | A | A | B |
| Ink Prep. Ex. 18 | B | A | Comp. Ex. 6 | 1 | A | A | A | B |
| Ink Prep. Ex. 19 | B | B | Comp. Ex. 7 | 1 | B | B | B | C |
| Ink Prep. Ex. 20 | B | B | Comp. Ex. 8 | 1 | B | B | B | C |

TABLE 7

| | Evaluation of receding contact angle | Evaluation of static surface tension | | Waveform | Ejection stability | Uniformity in solid area |
|---|---|---|---|---|---|---|
| Ink Prep. Ex. 1 | A | A | Comp. Ex. 9 | 2 | C | B |
| Ink Prep. Ex. 2 | A | A | Comp. Ex. 10 | 2 | C | B |
| Ink Prep. Ex. 3 | A | A | Comp. Ex. 11 | 2 | C | B |
| Ink Prep. Ex. 4 | A | A | Comp. Ex. 12 | 2 | C | B |
| Ink Prep. Ex. 5 | A | A | Comp. Ex. 13 | 2 | C | B |
| Ink Prep. Ex. 6 | A | A | Comp. Ex. 14 | 2 | C | B |
| Ink Prep. Ex. 7 | A | A | Comp. Ex. 15 | 2 | C | B |
| Ink Prep. Ex. 8 | A | A | Comp. Ex. 16 | 2 | C | B |
| Ink Prep. Ex. 9 | A | A | Comp. Ex. 17 | 2 | C | B |
| Ink Prep. Ex. 10 | A | A | Comp. Ex. 18 | 2 | C | B |
| Ink Prep. Ex. 11 | A | A | Comp. Ex. 19 | 2 | C | B |
| Ink Prep. Ex. 12 | A | A | Comp. Ex. 20 | 2 | C | B |
| Ink Prep. Ex. 13 | A | B | Comp. Ex. 21 | 2 | C | C |
| Ink Prep. Ex. 14 | A | B | Comp. Ex. 22 | 2 | C | C |
| Ink Prep. Ex. 15 | B | A | Comp. Ex. 23 | 2 | C | B |
| Ink Prep. Ex. 16 | B | A | Comp. Ex. 24 | 2 | C | B |
| Ink Prep. Ex. 17 | B | A | Comp. Ex. 25 | 2 | C | B |
| Ink Prep. Ex. 18 | B | A | Comp. Ex. 26 | 2 | C | B |
| Ink Prep. Ex. 19 | B | B | Comp. Ex. 27 | 2 | C | C |
| Ink Prep. Ex. 20 | B | B | Comp. Ex. 28 | 2 | C | C |

(1) Evaluation of ejection stability: It has been found from Examples 1 to 12 that the ejection waveform including the pull pulse for pulling the meniscus in the two-step manner (two-step pulling waveform) can achieve good ejection stability even in the case of using the ink having a low static surface tension and a large receding contact angle.

(2) Evaluation of ejection stability: It has been found from comparison between Examples 1 to 12 and Comparative Examples 9 to 20 that the ink having a low static surface tension and a small receding contact angle cannot achieve good ejection stability unless the two-step pulling waveform is applied thereto.

(3) Uniformity in solid area: It has been found from comparison between Examples 1 to 12 and Comparative Examples 1, 2, 7, 8 that the solid area is poor in uniformity in the case where the static surface tension does not fall within the defined range. This is because, in the case where the static surface tension falls within the defined range, the impacted ink rapidly penetrates into a surface of the sheet due to its low static surface tension, so that beading is not easily caused.

(4) Evaluation of permeability into recording media: It has been found from comparison between Examples 1 to 12 and Comparative Examples 1 and 2, and Comparative Examples 3 to 8 that the permeability of ink into recording media is poor in the case where the receding contact angle does not fall within the defined range. This is because, in the case where the receding contact angle falls within the defined range, the impacted ink penetrates more uniformly than an ink having a larger receding contact angle in the process of penetration of ink droplets on the surface of the sheet, so that the ink more rapidly penetrates into the recording media.

Ink Preparation Examples 101 to 126

Ink Preparation Examples 101 to 126 were produced by a routine procedure according to formulations described in Tables 8 to 12 using pigment dispersions produced in Pigment dispersion Production Examples 1 to 4, and adjusted to pH 9 with a 10% aqueous sodium hydroxide solution. Notably, the unit of numerical values described in Tables 8 to 12 is "% by mass."

Specifically, a water-soluble organic solvent, a surfactant, an antifungal agent, a foam inhibitor, a defoaming agent, a penetrating agent, and ion-exchanged water were mixed in this order, following by stirring for 30 min. Then, each of the pigment dispersions produced in Pigment dispersion Production Examples 1 to 4 was added thereto, followed by stirring for 30 min and filtering through a membrane filter (pore diameter: 0.8 μm) to thereby obtain each of Ink Preparation Examples 101 to 126.

TABLE 8

| | | Ink Preparation Example | | | | | |
|---|---|---|---|---|---|---|---|
| | | 101 | 102 | 103 | 104 | 105 | 106 |
| Dispersion Production Example 1 | C | 45.0 | | | | 42.0 | |
| Dispersion Production Example 2 | M | | 53.0 | | | | 50.0 |
| Dispersion Production Example 3 | Y | | | 42.0 | | | |
| Dispersion Production Example 4 | K | | | | 50.0 | | |
| Surfactant | Surfactant A | 0.03 | 0.03 | 0.04 | 0.03 | 0.06 | 0.06 |
| | Surfactant B | | | | | | |
| | Surfactant C | | | | | | |
| | Surfactant D | | | | | | |
| Water-Soluble Organic Solvent | Glycerin | | | | | | |
| | 3-methyl-1,3-butanediol | | | | | | |
| | 1,3-butanediol | | | | | 10.0 | 10.0 |
| | 1,2-butanediol | 8.0 | | 8.0 | 13.0 | | |
| | 1,2-propanediol | 30.0 | 38.0 | 35.0 | 26.0 | 25.0 | |
| | 1,6-hexanediol | | | | | | |
| | 1,5-pentanediol | | | | | | 25.0 |
| | 2-pyrrolidone | | | | | | |
| Foam Inhibitor | 2,4,7,9-tetramethyldecane-4,7-diol | 0.20 | 0.20 | 0.20 | 0.20 | 0.40 | 0.40 |
| Defoaming Agent | KM-72F | | | | | | |
| Penetrating Agent | 2-ethyl-1,3-hexanediol | 3.0 | 3.0 | 2.0 | 2.0 | 2.5 | 2.5 |
| Antifungal Agent | PROXEL LV | 0.10 | 0.10 | 0.10 | 0.10 | 0.10 | 0.10 |
| pH adjusting agent | 10% aqueous sodium hydroxide solution | q.s. | q.s. | q.s. | q.s. | q.s. | q.s. |
| | Pure Water | Balance | Balance | Balance | Balance | Balance | Balance |
| | Total (% by mass) | 100.0 | 100.0 | 100.0 | 100.0 | 100.0 | 100.0 |

TABLE 9

| | | Ink Preparation Example | | | | | |
|---|---|---|---|---|---|---|---|
| | | 107 | 108 | 109 | 110 | 111 | 112 |
| Dispersion Production Example 1 | C | | | 15.0 | | | |
| Dispersion Production Example 2 | M | | | | 18.0 | | |
| Dispersion Production Example 3 | Y | 40.0 | | | | 13.0 | |
| Dispersion Production Example 4 | K | | 55.0 | | | | 20.0 |
| Surfactant | Surfactant A | 0.06 | 0.04 | | | | |
| | Surfactant B | | | 5.00 | 5.00 | 5.00 | 5.00 |
| | Surfactant C | | | | | | |
| | Surfactant D | | | | | | |
| Water Soluble Organic Solvent | Glycerin | | | 25.0 | 20.0 | 30.0 | 20.0 |
| | 3-methyl-1,3-butanediol | | | | 20.0 | | 25.0 |
| | 1,3-butanediol | | 10.0 | 10.0 | | | |
| | 1,2-butanediol | 14.0 | | 12.0 | | | |
| | 1,2-propanediol | | | | | 15.0 | |
| | 1,6-hexanediol | 28.0 | | | | | |
| | 1,5-pentanediol | | 20.0 | | | | |
| | 2-pyrrolidone | | | | 2.0 | | |
| Foam Inhibitor | 2,4,7,9-tetramethyldecane-4,7-diol | 0.40 | 0.40 | | | | |
| Defoaming Agent | KM-72F | | | 0.80 | 0.80 | 0.80 | 0.80 |
| Penetrating Agent | 2-ethyl-1,3-hexanediol | 2.5 | 2.5 | 2.5 | 2.5 | 2.5 | 2.5 |
| Antifungal Agent | PROXEL LV | 0.10 | 0.10 | 0.20 | 0.20 | 0.20 | 0.20 |
| pH adjusting agent | 10% aqueous sodium hydroxide solution | q.s. | q.s. | q.s. | q.s. | q.s. | q.s. |
| | Pure Water | Balance | Balance | Balance | Balance | Balance | Balance |
| | Total (% by mass) | 100.0 | 100.0 | 100.0 | 100.0 | 100.0 | 100.0 |

TABLE 10

| | | Ink Preparation Example | | | | | |
|---|---|---|---|---|---|---|---|
| | | 113 | 114 | 115 | 116 | 117 | 118 |
| Dispersion Production Example 1 | C | 15.0 | | | | 20.0 | |
| Dispersion Production Example 2 | M | | 20.0 | | | | 25.0 |
| Dispersion Production Example 3 | Y | | | 15.0 | | | |
| Dispersion Production Example 4 | K | | | | 25.0 | | |
| Surfactant | Surfactant A | | | | | | |
| | Surfactant B | | | | | | |
| | Surfactant C | 0.40 | 0.40 | 0.40 | 0.30 | | |
| | Surfactant D | | | | | 2.20 | 2.20 |
| Water Soluble Organic Solvent | Glycerin | 7.0 | 7.0 | 8.0 | 8.0 | 15.0 | 15.0 |
| | 3-methyl-1,3-butanediol | | | | | | |
| | 1,3-butanediol | | | | | | |
| | 1,2-butanediol | | | | | | |
| | 1,2-propanediol | | | | | | 20.0 |
| | 1,6-hexanediol | | | 25.0 | 25.0 | 18.0 | |
| | 1,5-pentanediol | 25.0 | 25.0 | | | | |
| | 2-pyrrolidone | 2.0 | 2.0 | 2.0 | 2.0 | | |
| Foam Inhibitor | 2,4,7,9-tetramethyldecane-4,7-diol | 0.20 | 0.20 | 0.23 | 0.23 | | |
| Defoaming Agent | KM-72F | | | | | 0.50 | 0.50 |

TABLE 10-continued

| | | Ink Preparation Example | | | | | |
|---|---|---|---|---|---|---|---|
| | | 113 | 114 | 115 | 116 | 117 | 118 |
| Penetrating Agent | 2-ethyl-1,3-hexanediol | 2.5 | 2.5 | 2.5 | 2.5 | 2.0 | 2.0 |
| Antifungal Agent | PROXEL LV | 0.20 | 0.20 | 0.20 | 0.20 | 0.25 | 0.25 |
| pH adjusting agent | 10% aqueous sodium hydroxide solution | q.s. | q.s. | q.s. | q.s. | q.s. | q.s. |
| | Pure Water | Balance | Balance | Balance | Balance | Balance | Balance |
| | Total (% by mass) | 100.0 | 100.0 | 100.0 | 100.0 | 100.0 | 100.0 |

TABLE 11

| | | Ink Preparation Example | | | | | |
|---|---|---|---|---|---|---|---|
| | | 119 | 120 | 121 | 122 | 123 | 124 |
| Dispersion Production Example 1 | C | | | 25.0 | | | |
| Dispersion Production Example 2 | M | | | | 35.0 | | |
| Dispersion Production Example 3 | Y | 22.0 | | | | 20.0 | |
| Dispersion Production Example 4 | K | | 27.0 | | | | 25.0 |
| Surfactant | Surfactant A | | | 0.02 | 0.02 | 0.02 | 0.02 |
| | Surfactant B | | | | | | |
| | Surfactant C | | | | | | |
| | Surfactant D | 2.20 | 2.20 | | | | |
| Water Soluble Organic Solvent | Glycerin | 15.0 | 15.0 | 12.0 | 10.0 | 10.0 | 10.0 |
| | 3-methyl-1,3-butanediol | | | | | | 20.0 |
| | 1,3-butanediol | | | | | | |
| | 1,2-butanediol | | 24.0 | 24.0 | | | |
| | 1,2-propanediol | | | | 20.0 | | |
| | 1,6-hexanediol | | | | | 25.0 | |
| | 1,5-pentanediol | 23.0 | | | | | |
| | 2-pyrrolidone | | | | | | |
| Foam Inhibitor | 2,4,7,9-tetramethyldecane-4,7-diol | | | 0.15 | 0.15 | 0.15 | 0.15 |
| Defoaming Agent | KM-72F | 0.50 | 0.50 | | | | |
| Penetrating Agent | 2-ethyl-1,3-hexanediol | 2.0 | 2.0 | 4.0 | 4.0 | 4.0 | 4.0 |
| Antifungal Agent | PROXEL LV | 0.25 | 0.25 | 0.25 | 0.25 | 0.25 | 0.25 |
| pH adjusting agent | 10% aqueous sodium hydroxide solution | q.s. | q.s. | q.s. | q.s. | q.s. | q.s. |
| | Pure Water | Balance | Balance | Balance | Balance | Balance | Balance |
| | Total (% by mass) | 100.0 | 100.0 | 100.0 | 100.0 | 100.0 | 100.0 |

TABLE 12

| | | Ink Preparation Example | |
|---|---|---|---|
| | | 125 | 126 |
| Dispersion Production Example 1 | C | | |
| Dispersion Production Example 2 | M | | |
| Dispersion Production Example 3 | Y | | |
| Dispersion Production Example 4 | K | 50.0 | 50.0 |
| Surfactant | Surfactant A | 0.10 | 0.01 |
| | Surfactant B | | |
| | Surfactant C | | |
| | Surfactant D | | |
| Water Soluble Organic Solvent | Glycerin | | |
| | 3-methyl-1,3-butanediol | | |
| | 1,3-butanediol | | |
| | 1,2-butanediol | 13.0 | 13.0 |
| | 1,2-propanediol | 26.0 | 26.0 |
| | 1,6-hexanediol | | |
| | 1,5-pentanediol | | |
| | 2-pyrrolidone | | |

TABLE 12-continued

| | | Ink Preparation Example | |
|---|---|---|---|
| | | 125 | 126 |
| Foam Inhibitor | 2,4,7,9-tetramethyldecane-4,7-diol | 0.50 | 0.03 |
| Defoaming Agent | KM-72F | | |
| Penetrating Agent | 2-ethyl-1,3-hexanediol | 2.0 | 2.0 |
| Antifungal Agent | PROXEL LV | 0.10 | 0.10 |
| pH adjusting agent | 10% aqueous sodium hydroxide solution | q.s. | q.s. |
| | Pure Water | Balance | Balance |
| Total (% by mass) | | 100.0 | 100.0 |

<Physical Properties of Ink>

The inks of the above Ink Preparation Examples 101 to 126 were measured for the viscosity, the static surface tension, and the receding contact angle in the same manner as in Ink Preparation Examples 1 to 20. Results are shown in Table 13.

As for the static surface tension, 18.0 mN/m to 27.0 mN/m is determined as "A" and less than 18.0 mN/m or more than 27.0 mN/m is determined as "B." Similarly, as for the receding contact angle, less than 50° is determined as "A" and 50° or more is determined as "B." Results are also shown in Table 13.

TABLE 13

| | | Static Surface Tension | | | |
|---|---|---|---|---|---|
| | | Measurement | | Receding Contact Angle | |
| | Viscosity (mPa · s) | Value of Static Surface Tension (mN/m) | Evaluation | Measurement Value of Receding Contact Angle (°) | Evaluation |
| Ink Prep. Ex. 101 | 8.21 | 22.1 | A | 41 | A |
| Ink Prep. Ex. 102 | 8.34 | 23.3 | A | 40 | A |
| Ink Prep. Ex. 103 | 8.03 | 20.9 | A | 37 | A |
| Ink Prep. Ex. 104 | 8.36 | 24.7 | A | 46 | A |
| Ink Prep. Ex. 105 | 8.17 | 20.3 | A | 40 | A |
| Ink Prep. Ex. 106 | 8.14 | 21.0 | A | 38 | A |
| Ink Prep. Ex. 107 | 7.77 | 19.9 | A | 35 | A |
| Ink Prep. Ex. 108 | 8.06 | 21.5 | A | 44 | A |
| Ink Prep. Ex. 109 | 7.98 | 18.8 | A | 30 | A |
| Ink Prep. Ex. 110 | 8.05 | 18.6 | A | 30 | A |
| Ink Prep. Ex. 111 | 8.15 | 19.0 | A | 33 | A |
| Ink Prep. Ex. 112 | 8.24 | 19.5 | A | 33 | A |
| Ink Prep. Ex. 113 | 7.92 | 21.2 | A | 43 | A |
| Ink Prep. Ex. 114 | 8.03 | 21.5 | A | 44 | A |
| Ink Prep. Ex. 115 | 7.86 | 21.1 | A | 42 | A |
| Ink Prep. Ex. 116 | 8.01 | 22.0 | A | 47 | A |
| Ink Prep. Ex. 117 | 7.42 | 28.1 | B | 48 | A |
| Ink Prep. Ex. 118 | 7.57 | 28.7 | B | 49 | A |
| Ink Prep. Ex. 119 | 7.63 | 28.0 | B | 47 | A |
| Ink Prep. Ex. 120 | 7.43 | 29.0 | B | 49 | A |
| Ink Prep. Ex. 121 | 7.86 | 23.2 | A | 61 | B |
| Ink Prep. Ex. 122 | 7.86 | 23.7 | A | 65 | B |
| Ink Prep. Ex. 123 | 7.81 | 22.7 | A | 60 | B |
| Ink Prep. Ex. 124 | 7.77 | 24.0 | A | 65 | B |
| Ink Prep. Ex. 125 | 8.32 | 17.1 | B | 29 | A |
| Ink Prep. Ex. 126 | 8.37 | 34.5 | B | 75 | B |

Each of the inks of the above Ink Preparation Examples 101 to 126 was used to produce Ink sets 1 to 8 including combinations of inks described in the following Table 14.

TABLE 14

| Ink Set | Color | Ink |
|---|---|---|
| Ink Set 1 | C | Ink Prep. Ex. 101 |
| | M | Ink Prep. Ex. 102 |
| | Y | Ink Prep. Ex. 103 |
| | K | Ink Prep. Ex. 104 |
| Ink Set 2 | C | Ink Prep. Ex. 105 |
| | M | Ink Prep. Ex. 106 |
| | Y | Ink Prep. Ex. 107 |
| | K | Ink Prep. Ex. 108 |
| Ink Set 3 | C | Ink Prep. Ex. 109 |
| | M | Ink Prep. Ex. 110 |
| | Y | Ink Prep. Ex. 111 |
| | K | Ink Prep. Ex. 112 |
| Ink Set 4 | C | Ink Prep. Ex. 113 |
| | M | Ink Prep. Ex. 114 |
| | Y | Ink Prep. Ex. 115 |
| | K | Ink Prep. Ex. 116 |
| Ink Set 5 | C | Ink Prep. Ex. 101 |
| | M | Ink Prep. Ex. 102 |
| | Y | Ink Prep. Ex. 103 |
| | K | Ink Prep. Ex. 125 |
| Ink Set 6 | C | Ink Prep. Ex. 101 |
| | M | Ink Prep. Ex. 102 |
| | Y | Ink Prep. Ex. 103 |
| | K | Ink Prep. Ex. 126 |
| Ink Set 7 | C | Ink Prep. Ex. 117 |
| | M | Ink Prep. Ex. 118 |
| | Y | Ink Prep. Ex. 119 |
| | K | Ink Prep. Ex. 120 |
| Ink Set 8 | C | Ink Prep. Ex. 121 |
| | M | Ink Prep. Ex. 122 |
| | Y | Ink Prep. Ex. 123 |
| | K | Ink Prep. Ex. 124 |

Examples 101 to 104 and Comparative Examples 101 to 112

The produced Ink sets 1 to 8 were evaluated for the ejection stability, the uniformity in solid area, and the permeability into recording media in the same manner as in Examples 1 to 10 and Comparative Examples 1 to 26, and also evaluated for bleed between the black ink and the other color ink in the following manner.

Compositions of Ink sets are shown in Tables 15 and 16. Evaluation results for the ejection stability, the uniformity in solid area, the permeability into recording media, and the bleed between black ink and other color ink are shown in Tables 17 and 18.

The cases where "Waveform 1" was applied to Ink sets 1 to 4 were determined as Examples 101 to 104. The cases where "Waveform 1" was applied to Ink sets 5 to 8 were determined as Comparative Examples 101 to 104. On the other hand, the cases where "Waveform 2" was applied to Ink sets 1 to 8 were determined as Comparative Examples 105 to 112.

Prior to evaluation, the ink was deposited onto a surface of the nozzle plate and wiped off with a wiper blade. This procedure was repeated 2,000 times. Thus, the water-repellent film on the surface of the nozzle plate was intentionally deteriorated.

<Evaluation for Bleed Between Black Ink and Other Color Ink>

This evaluation was performed in only "Waveform 1".

Printing was performed on MY PAPER (manufactured by Ricoh Japan Corporation) by means of the inkjet printer (manufactured by Ricoh Company Ltd., IPSIO GXE3300). As for a printing pattern, each color ink was printed at 100%-duty. As for the printing conditions, the recording density was 600 dpi, and the printing was carried out with one-pass printing. Printing samples were produced for only Waveform 1.

The black ink was used to print characters on the resultant solid image area of each color ink. Bleed (blur) between the black ink and the other color ink was visually observed and evaluated according to the following criteria, where "A" is considered to be a pass and "B" and "C" are considered to be a failure.

[Evaluation Criteria]

A: There was no bleed, black characters were clearly recognized, and there was no blur.

B: Bleed was slightly occurred, and black characters were slightly blurred.

C: Bleed was occurred, and black characters were difficult to be recognized.

In Tables 15 and 16, the static surface tension and the receding contact angle of each ink, and the difference in the static surface tension between the black ink and all of other color inks [(Black ink—All of other color inks)] are described.

As for the receding contact angle, less than 50° was determined as "A" and 50° or more was determined as "B." As for the static surface tension, 18.0 mN/m to 27.0 mN/m was determined as "A" and less than 18.0 mN/m or more than 27.0 mN/m was determined as "B."

As for the difference in the static surface tension between the black ink and all of other color inks [(Black ink—All of other color inks)], 0 mN/m to 4 mN/m was determined as "A" and less than 0 mN/m or more than 4 mN/m was determined as "B."

TABLE 15

| | Combination of ink | | Static surface tension: Measurement value of static surface tension | | Difference in static surface tension between black ink and color ink: Value of difference | |
|---|---|---|---|---|---|---|
| Ink set | Color | Ink | (mN/m) | Evaluation | (mN/m) | Evaluation |
| Ink set 1 | C | Ink Prep. Ex. 101 | 22.1 | A | 2.6 | A |
| | M | Ink Prep. Ex. 102 | 23.3 | A | 1.4 | |
| | Y | Ink Prep. Ex. 103 | 20.9 | A | 3.8 | |
| | K | Ink Prep. Ex. 104 | 24.7 | A | — | |

TABLE 15-continued

| Ink set | Combination of ink: Color | Combination of ink: Ink | Static surface tension: Measurement value of static surface tension (mN/m) | Static surface tension: Evaluation | Difference in static surface tension between black ink and color ink: Value of difference (mN/m) | Difference in static surface tension between black ink and color ink: Evaluation |
|---|---|---|---|---|---|---|
| Ink set 2 | C | Ink Prep. Ex. 105 | 20.3 | A | 1.2 | A |
| | M | Ink Prep. Ex. 106 | 21.0 | A | 0.5 | |
| | Y | Ink Prep. Ex. 107 | 19.9 | A | 1.6 | |
| | K | Ink Prep. Ex. 108 | 21.5 | A | — | |
| Ink set 3 | C | Ink Prep. Ex. 109 | 18.8 | A | 0.7 | A |
| | M | Ink Prep. Ex. 110 | 18.6 | A | 0.9 | |
| | Y | Ink Prep. Ex. 111 | 19.0 | A | 0.5 | |
| | K | Ink Prep. Ex. 112 | 19.5 | A | — | |
| Ink set 4 | C | Ink Prep. Ex. 113 | 21.2 | A | 0.8 | A |
| | M | Ink Prep. Ex. 114 | 21.5 | A | 0.5 | |
| | Y | Ink Prep. Ex. 115 | 21.1 | A | 0.9 | |
| | K | Ink Prep. Ex. 116 | 22.0 | A | — | |
| Ink set 5 | C | Ink Prep. Ex. 101 | 22.1 | A | −5.0 | B |
| | M | Ink Prep. Ex. 102 | 23.3 | A | −6.2 | |
| | Y | Ink Prep. Ex. 103 | 20.9 | A | −3.8 | |
| | K | Ink Prep. Ex. 125 | 17.1 | B | — | |
| Ink set 6 | C | Ink Prep. Ex. 101 | 22.1 | A | 12.4 | B |
| | M | Ink Prep. Ex. 102 | 23.3 | A | 11.2 | |
| | Y | Ink Prep. Ex. 103 | 20.9 | A | 13.6 | |
| | K | Ink Prep. Ex. 126 | 34.5 | B | — | |
| Ink set 7 | C | Ink Prep. Ex. 117 | 28.1 | B | 0.9 | A |
| | M | Ink Prep. Ex. 118 | 28.7 | B | 0.3 | |
| | Y | Ink Prep. Ex. 119 | 28.0 | B | 1.0 | |
| | K | Ink Prep. Ex. 120 | 29.0 | B | — | |
| Ink set 8 | C | Ink Prep. Ex. 121 | 23.2 | A | 0.8 | A |
| | M | Ink Prep. Ex. 122 | 23.7 | A | 0.3 | |
| | Y | Ink Prep. Ex. 123 | 22.7 | A | 1.3 | |
| | K | Ink Prep. Ex. 124 | 24.0 | A | — | |

TABLE 16

| Ink set | Combination of ink: Color | Combination of ink: Ink | Receding contact angle: Measurement value of receding contact angle (°) | Receding contact angle: Evaluation |
|---|---|---|---|---|
| Ink set 1 | C | Ink Prep. Ex. 101 | 41 | A |
| | M | Ink Prep. Ex. 102 | 40 | A |
| | Y | Ink Prep. Ex. 103 | 37 | A |
| | K | Ink Prep. Ex. 104 | 46 | A |
| Ink set 2 | C | Ink Prep. Ex. 105 | 40 | A |
| | M | Ink Prep. Ex. 106 | 38 | A |
| | Y | Ink Prep. Ex. 107 | 35 | A |
| | K | Ink Prep. Ex. 108 | 44 | A |
| Ink set 3 | C | Ink Prep. Ex. 109 | 30 | A |
| | M | Ink Prep. Ex. 110 | 30 | A |
| | Y | Ink Prep. Ex. 111 | 33 | A |
| | K | Ink Prep. Ex. 112 | 33 | A |
| Ink set 4 | C | Ink Prep. Ex. 113 | 43 | A |
| | M | Ink Prep. Ex. 114 | 44 | A |
| | Y | Ink Prep. Ex. 115 | 42 | A |
| | K | Ink Prep. Ex. 116 | 47 | A |
| Ink set 5 | C | Ink Prep. Ex. 101 | 41 | A |
| | M | Ink Prep. Ex. 102 | 40 | A |

TABLE 16-continued

| Ink set | Combination of ink: Color | Combination of ink: Ink | Receding contact angle: Measurement value of receding contact angle (°) | Receding contact angle: Evaluation |
|---|---|---|---|---|
| | Y | Ink Prep. Ex. 103 | 37 | A |
| | K | Ink Prep. Ex. 125 | 29 | A |
| Ink set 6 | C | Ink Prep. Ex. 101 | 41 | A |
| | M | Ink Prep. Ex. 102 | 40 | A |
| | Y | Ink Prep. Ex. 103 | 37 | A |
| | K | Ink Prep. Ex. 126 | 75 | B |
| Ink set 7 | C | Ink Prep. Ex. 117 | 48 | A |
| | M | Ink Prep. Ex. 118 | 49 | A |
| | Y | Ink Prep. Ex. 119 | 47 | A |
| | K | Ink Prep. Ex. 120 | 49 | A |
| Ink set 8 | C | Ink Prep. Ex. 121 | 61 | B |
| | M | Ink Prep. Ex. 122 | 65 | B |
| | Y | Ink Prep. Ex. 123 | 60 | B |
| | K | Ink Prep. Ex. 124 | 65 | B |

TABLE 17

| Ink set | | Evaluation through application of Waveform 1 | Ejection stability | Uniformity in solid area | Bleed between black and color | Permeability into recording media Paper 1 | Paper 2 |
|---|---|---|---|---|---|---|---|
| Ink set 1 | C | Ex. 101 | A | A | A | AA | A |
| | M | | A | A | A | AA | A |
| | Y | | A | A | A | AA | A |
| | K | | A | A | — | AA | A |
| Ink set 2 | C | Ex. 102 | A | A | A | AA | A |
| | M | | A | A | A | AA | A |
| | Y | | A | A | A | AA | A |
| | K | | A | A | — | AA | A |
| Ink set 3 | C | Ex. 103 | A | A | A | AA | A |
| | M | | A | A | A | AA | A |
| | Y | | A | A | A | AA | A |
| | K | | A | A | — | AA | A |
| Ink set 4 | C | Ex. 104 | A | A | A | AA | A |
| | M | | A | A | A | AA | A |
| | Y | | A | A | A | AA | A |
| | K | | A | A | — | AA | A |
| Ink set 5 | C | Comp. Ex. 101 | A | A | C | AA | A |
| | M | | A | A | C | AA | A |
| | Y | | A | A | C | AA | A |
| | K | | A | A | — | AA | A |
| Ink set 6 | C | Comp. Ex. 102 | A | A | B | AA | A |
| | M | | A | A | B | AA | A |
| | Y | | A | A | B | AA | A |
| | K | | A | C | — | B | C |
| Ink set 7 | C | Comp. Ex. 103 | B | C | B | AA | A |
| | M | | B | C | B | AA | A |
| | Y | | B | C | B | AA | A |
| | K | | B | C | — | AA | A |
| Ink set 8 | C | Comp. Ex. 104 | A | A | B | A | C |
| | M | | A | A | B | A | C |
| | Y | | A | A | B | A | C |
| | K | | A | A | — | A | C |

TABLE 18

| Ink set | | Evaluation through application of Waveform 2 | Ejection stability | Uniformity in solid area |
|---|---|---|---|---|
| Ink set 1 | C | Comp. Ex. 105 | C | B |
| | M | | C | B |
| | Y | | C | B |
| | K | | C | B |
| Ink set 2 | C | Comp. Ex. 106 | C | B |
| | M | | C | B |
| | Y | | C | B |
| | K | | C | B |
| Ink set 3 | C | Comp. Ex. 107 | C | B |
| | M | | C | B |
| | Y | | C | B |
| | K | | C | B |
| Ink set 4 | C | Comp. Ex. 108 | C | B |
| | M | | C | B |
| | Y | | C | B |
| | K | | C | B |
| Ink set 5 | C | Comp. Ex. 109 | C | B |
| | M | | C | B |
| | Y | | C | B |
| | K | | C | B |
| Ink set 6 | C | Comp. Ex. 110 | C | B |
| | M | | C | B |
| | Y | | C | B |
| | K | | C | C |
| Ink set 7 | C | Comp. Ex. 111 | C | C |
| | M | | C | C |
| | Y | | C | C |
| | K | | C | C |

TABLE 18-continued

| Ink set | | Evaluation through application of Waveform 2 | Ejection stability | Uniformity in solid area |
|---|---|---|---|---|
| Ink set 8 | C | Comp. Ex. 112 | C | B |
| | M | | C | B |
| | Y | | C | B |
| | K | | C | B |

(1) Evaluation of ejection stability: It has been found from Examples 101 to 104 that the ejection waveform including the pull pulse for pulling the meniscus in the two-step manner (two-step pulling waveform) can achieve good ejection stability even in the case of using the ink having a static surface tension and a receding contact angle static surface tension that fall within the defined ranges.

(2) Evaluation of ejection stability: It has been found from comparison between Examples 101 to 104 and Comparative Examples 105 to 108 that the ink having a static surface tension and a receding contact angle that fall within the defined ranges cannot achieve good ejection stability unless the two-step pulling waveform is applied thereto.

(3) Uniformity in solid area: It has been found from comparison between Examples 101 to 104 and Comparative Examples 102 and 103 that the solid area is poor in uniformity in the case where the static surface tension does not fall within the defined range. This is because, in the case where the static surface tension falls within the defined range, the impacted ink rapidly penetrates into a surface of the sheet clue to its low static surface tension, so that beading is not easily caused.

(4) Evaluation of bleed between black ink and other color ink: It can be seen from comparison between Examples 101 to 104 and Comparative Examples 101 to 104 that in the case of the inks having the static surface tension out of the defined range (18 mN/m to 27 mN/m), bleed and blur were produced. This is because unbalanced static surface tension between the black ink and the other color inks causes black characters to be thinned and blurred during penetration of the ink into the surface of the sheet. It also can be seen that bleed and blur were produced in the case having the difference in static surface tension out of the defined range [(black ink)−(the other color ink)]: 0 mN/m to 4 mN/m] and the receding contact angle out of the defined range (less than 50°).

(5) Evaluation of permeability into recording media: It has been found from comparison between Examples 101 to 104 and Comparative Examples 101 to 104 that the permeability of ink into recording media is poor in the case where the receding contact angle does not fall within the defined range. This was particularly notable in [Paper 2] which had poorer absorbability of the ink.

In the case where the receding contact angle falls within the defined range, the impacted ink droplets rapidly penetrate into the recording medium, so that recording medium is not easily stained even after rubbing. In contrast, the ink having a larger receding contact angle slowly penetrates into the recording medium, so that the recording medium is easily stained by rubbing.

According to an inkjet recording method of the present invention, even when the water-repellent film is gradually deteriorated due to a physical load applied during a maintenance work for keeping a surface of the nozzle plate on which the nozzle constituting the droplet ejection head is formed clean, an ink having a low static surface tension and a small receding contact angle can be ejected stably as ink droplets from the liquid ejection head. In addition, printed matter which is good in image quality with little blur between the black ink and the other color inks (e.g., uniformity in solid area and no bleed between the black ink and the other color inks) can be provided.

Aspects of the present invention are as follows.

<1> An inkjet recording method, which is performed by an inkjet recording device containing: a nozzle plate provided with a nozzle configured to eject droplets of an ink; a recording head containing a liquid chamber with which the nozzle is in communication, and a pressure generating unit configured to generate pressure in the liquid chamber; and a signal generating unit configured to generate a signal to be applied to the pressure generating unit, and which allows the droplets of the ink to eject by the pressure which is generated by the pressure generating unit according to the signal, wherein the ink has a static surface tension of 18.0 mN/m to 27.0 mN/m at 25° C., wherein the ink has a receding contact angle on the nozzle plate of less than 50°, wherein the signal has a two-step pull pulse for pulling the ink into the nozzle in a two-step manner within one printing unit cycle, and wherein the inkjet recording method includes pulling the ink located in proximity to a nozzle outlet into the nozzle by the two-step pull pulse, to thereby form a meniscus at a predetermined position.

<2> The inkjet recording method according to <1>, wherein, in the signal within one printing unit cycle, the pull pulse is present prior to an ejection pulse for ejecting the ink.

<3> The inkjet recording method according to <1> or <2>, wherein a surface of the nozzle plate contains a water-repellent film.

<4> The inkjet recording method according to any one of <1> to <3>, wherein the ink is an ink set including a black ink and one or more other color inks, wherein each ink in the ink set has the static surface tension of 18.0 mN/m to 27.0 mN/m at 25° C., wherein each ink in the ink set has the receding contact angle on the nozzle plate of less than 50°, and wherein a difference in the static surface tension between the black ink and other color ink or each of other color inks (black ink−other color ink or each of other color inks) is 0 mN/m to 4 mN/m at 25° C.

<5> The inkjet recording method according to any one of <1> to <4>, wherein the ink contains water, a colorant, a surfactant, and a water-soluble organic solvent.

<6> The inkjet recording method according to any one of <1> to <5>, wherein the ink has a viscosity of 3 mPa·s to 20 mPa·s at 25° C.

<7> An inkjet recording device, including a nozzle plate provided with a nozzle configured to eject droplets of an ink;

a recording head including a liquid chamber with which the nozzle is in communication, and a pressure generating unit configured to generate pressure in the liquid chamber; and a signal generating unit configured to generate a signal to be applied to the pressure generating unit, wherein the device allows the droplets of the ink to eject by the pressure which is generated by the pressure generating unit according to the signal, wherein the ink has a static surface tension of 18.0 mN/m to 27.0 mN/m at 25° C., wherein the ink has a receding contact angle on the nozzle plate of less than 50°, wherein the signal has a two-step pull pulse for pulling the ink into the nozzle in a two-step manner within one printing unit cycle, and wherein the device includes a unit configured to allow the ink located in proximity to a nozzle outlet to be pulled into the nozzle by the two-step pull pulse, to thereby form a meniscus at a predetermined position.

<8> The inkjet recording device according to <7>, wherein, in the signal within one printing unit cycle, the pull pulse is present prior to an ejection pulse for ejecting the ink.

<9> The inkjet recording device according to <7> or <8>, wherein a surface of the nozzle plate has a water-repellent film.

<10> The inkjet recording method according to any one of <7> to <9>, wherein the ink is an ink set containing a black ink and one or more other color inks, wherein each ink in the ink set has the static surface tension of 18.0 mN/m to 27.0 mN/m at 25° C., wherein each ink in the ink set has the receding contact angle on the nozzle plate of less than 50°, and wherein a difference in the static surface tension between the black ink and other color ink or each of other color inks (black ink−other color ink or each of other color inks) is 0 mN/m to 4 mN/m at 25° C.

<11> The inkjet recording device according to any one of <7> to <10>, wherein the ink contains water, a colorant, a surfactant, and a water-soluble organic solvent.

<12> The inkjet recording device according to any one of <7> to <11>, wherein the ink has a viscosity of 3 mPa·s to 20 mPa·s at 25° C.

<13> An ink recorded matter, including:

a recording medium; and an image on the recording medium, wherein the image is formed by the inkjet recording method according to any one of <1> to <6>.

This application claims priority to Japanese application No. 2014-236562, filed on Nov. 21, 2014 and incorporated herein by reference.

What is claimed is:

1. An inkjet recording method, which is performed by an inkjet recording device comprising: a nozzle plate comprising a nozzle configured to eject droplets of an ink; a recording head comprising a liquid chamber with which the nozzle is in communication, and a pressure generating unit configured to generate pressure in the liquid chamber; and a signal generating unit configured to generate a signal to be applied to the pressure generating unit, and which allows the droplets of the ink to eject by the pressure which is generated by the pressure generating unit according to the signal, wherein the ink has a static surface tension of 18.0 mN/m to 27.0 mN/m at 25° C., wherein the ink has a receding contact angle on the nozzle plate of less than 50°, wherein the signal has a two-step pull pulse for pulling the ink into the nozzle in a two-step manner within one printing unit cycle, and wherein the inkjet recording method comprises pulling the ink located in proximity to a nozzle outlet into the nozzle by the two-step pull pulse, to thereby form a meniscus at a predetermined position.

2. The inkjet recording method according to claim 1, wherein, in the signal within one printing unit cycle, the pull pulse is present prior to an ejection pulse for ejecting the ink.

3. The inkjet recording method according to claim 1, wherein a surface of the nozzle plate comprises a water-repellent film.

4. The inkjet recording method according to claim 1, wherein the ink is an ink set comprising a black ink and one or more other color inks, wherein each ink in the ink set has the static surface tension of 18.0 mN/m to 27.0 mN/m at 25° C., wherein each ink in the ink set has the receding contact angle on the nozzle plate of less than 50°, and wherein a difference in the static surface tension between the black ink and other color ink or each of other color inks (black ink—other color ink or each of other color inks) is 0 mN/m to 4 mN/m at 25° C.

5. The inkjet recording method according to claim 1, wherein the ink comprises water, a colorant, a surfactant, and a water-soluble organic solvent.

6. The inkjet recording method according to claim 1, wherein the ink has a viscosity of 3 mPa·s to 20 mPa·s at 25° C.

7. An ink recorded matter, comprising:

a recording medium; and an image on the recording medium, wherein the image is formed by the inkjet recording method according to claim 1.

8. An inkjet recording device, comprising:

a nozzle plate comprising a nozzle configured to eject droplets of an ink;

a recording head comprising a liquid chamber with which the nozzle is in communication, and a pressure generating unit configured to generate pressure in the liquid chamber; and a signal generating unit configured to generate a signal to be applied to the pressure generating unit, wherein the inkjet recording device allows the droplets of the ink to eject by the pressure which is generated by the pressure generating unit according to the signal, wherein the ink has a static surface tension of 18.0 mN/m to 27.0 mN/m at 25° C., wherein the ink has a receding contact angle on the nozzle plate of less than 50°, wherein the signal has a two-step pull pulse for pulling the ink into the nozzle in a two-step manner within one printing unit cycle, and wherein the inkjet recording device comprises a unit configured to allow the ink located in proximity to a nozzle outlet to be pulled into the nozzle by the two-step pull pulse, to thereby form a meniscus at a predetermined position.

9. The inkjet recording device according to claim 8, wherein, in the signal within one printing unit cycle, the pull pulse is present prior to an ejection pulse for ejecting the ink.

10. The inkjet recording device according to claim 8, wherein a surface of the nozzle plate comprises a water-repellent film.

11. The inkjet recording device according to claim 8, wherein the ink is an ink set comprising a black ink and one or more other color inks, wherein each ink in the ink set has the static surface tension of 18.0 mN/m to 27.0 mN/m at 25° C., wherein each ink in the ink set has the receding contact angle on the nozzle plate of less than 50°, and wherein a difference in the static surface tension between the black ink and other color ink or each of other color inks (black ink—other color ink or each of other color inks) is 0 mN/m to 4 mN/m at 25° C.

12. The inkjet recording device according to claim 8, wherein the ink comprises water, a colorant, a surfactant, and a water-soluble organic solvent.

13. The inkjet recording device according to claim 8, wherein the ink has a viscosity of 3 mPa·s to 20 mPa·s at 25° C.

* * * * *